US011264765B2

(12) United States Patent
Ho et al.

(10) Patent No.: US 11,264,765 B2
(45) Date of Patent: Mar. 1, 2022

(54) ELECTRICAL CONNECTOR AND ELECTRICAL CONNECTOR ASSEMBLY

(71) Applicant: LOTES CO., LTD, Keelung (TW)

(72) Inventors: Chien Chih Ho, Keelung (TW); Yong Jun Dai, Keelung (TW)

(73) Assignee: LOTES CO., LTD, Keelung (TW)

( * ) Notice: Subject to any disclaimer, the term of this patent is extended or adjusted under 35 U.S.C. 154(b) by 44 days.

(21) Appl. No.: 17/034,758

(22) Filed: Sep. 28, 2020

(65) Prior Publication Data

US 2021/0305754 A1 Sep. 30, 2021

(30) Foreign Application Priority Data

Mar. 31, 2020 (CN) ..... 202010247337.8

(51) Int. Cl.

| | |
|---|---|
| ***H01R 4/66*** | (2006.01) |
| ***H01R 13/6582*** | (2011.01) |
| ***H01R 12/55*** | (2011.01) |
| ***H01R 12/70*** | (2011.01) |
| ***H01R 12/71*** | (2011.01) |
| ***H01R 13/24*** | (2006.01) |
| ***H01R 13/6471*** | (2011.01) |

(52) U.S. Cl.

CPC ..... *H01R 13/6582* (2013.01); *H01R 12/55* (2013.01); *H01R 12/7082* (2013.01); *H01R 12/716* (2013.01); *H01R 13/2407* (2013.01); *H01R 13/6471* (2013.01)

(58) Field of Classification Search

CPC ..... H01R 13/6582; H01R 13/6471; H01R 13/2407; H01R 12/55; H01R 12/716; H01R 12/7082

USPC ..... 439/92, 108

See application file for complete search history.

(56) References Cited

U.S. PATENT DOCUMENTS

| | | | | |
|---|---|---|---|---|
| 7,828,597 | B1 * | 11/2010 | Jin | H01R 13/6477 439/607.05 |
| 10,283,910 | B1 * | 5/2019 | Chen | H01R 4/04 |
| 10,594,065 | B2 * | 3/2020 | Toh | H01R 13/405 |

FOREIGN PATENT DOCUMENTS

| | | | |
|---|---|---|---|
| CN | 101689736 | B | 6/2013 |
| CN | 206461179 | U | 9/2017 |
| CN | 107658588 | A | 2/2018 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical connector includes two adjacent terminal groups in a front-rear direction, including a front terminal group and a rear terminal group. Each terminal group includes a ground terminal and a signal terminal. The ground terminal has a first base portion and a first elastic arm. The first elastic arm includes two extending arms and a through slot formed therebetween. The signal terminal has a second base portion and a second elastic arm. The first elastic arm and the second elastic arm are used to be electrically connected to a mating member. In a same terminal group, the signal terminal is located in front of the first base portion, and the second elastic arm runs through the through slot. The mating member presses on the first elastic arm. The first elastic arm of the ground terminal of the rear terminal group abuts the ground terminal of the front terminal group.

35 Claims, 18 Drawing Sheets

C–C

ELECTRICAL CONNECTOR AND ELECTRICAL CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202010247337.8 filed in China on Mar. 31, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and an electrical connector assembly, and particularly to an electrical connector and an electrical connector assembly with good signal interference shielding effect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the higher requirement to high density of the electrical connector in the market, the interval between adjacent signal terminals become smaller, such that crosstalk interference may easily occur between the adjacent signal terminals, thereby reducing the quality of signal transmission. To enhance the stability of the signal transmission, ground terminals may be provided between adjacent signal terminals to shield the signal interference between the adjacent signal terminals, such that the terminals have the design to alternately arrange a row of signal terminals and a row of ground terminals. Thus, to facilitate the signal shielding between the adjacent signal terminals, it may be required to provide two rows of ground terminals at two sides of the row of signal terminals, and the arrangement of the terminals occupies an excessively large space, without providing an ideal shielding effect between the adjacent signal terminals.

Therefore, a heretofore unaddressed need to design a novel electrical connector and an electrical connector assembly exists in the art to address the aforementioned deficiencies and inadequacies.

SUMMARY

The present invention is directed to an electrical connector and an electrical connector assembly with good signal interference shielding effect.

To achieve the foregoing objective, one aspect of the present invention adopts the following technical solutions.

An electrical connector is configured to be electrically connected to a mating member. The electrical connector includes: two terminal groups, provided to be adjacent in a front-rear direction, wherein one of the two terminal groups located in front thereof is defined as a front terminal group, the other of the two terminal groups located behind is defined as a rear terminal group, each of the two terminal groups comprises a ground terminal and a signal terminal, the ground terminal is provided with a first base portion and a first elastic arm formed by extending from the first base portion, the first elastic arm comprises two extending arms and a through slot formed between the two extending arms, the signal terminal is provided with a second base portion and a second elastic arm formed by extending from the second base portion, and the first elastic arm and the second elastic arm are configured to be electrically connected to the mating member; wherein in a same terminal group of the two terminal groups, the signal terminal is located in front of the first base portion, and the second elastic arm runs through the through slot; wherein the mating member presses on the first elastic arm, and the first elastic arm of the ground terminal of the rear terminal group abuts the ground terminal of the front terminal group to form an electrical connection therebetween.

In certain embodiments, the first elastic arm is provided with a first contact portion, the second elastic arm is provided with a second contact portion, and in the same terminal group, the first contact portion is located in front of the second contact portion.

In certain embodiments, the first contact portions and the second contact portions in the two terminal groups are located on a same straight line extending along the front-rear direction.

In certain embodiments, the first elastic arm has a connecting arm, an end of each of the two extending arms located away from the first base portion is connected to the connecting arm, and the connecting arm of the first elastic arm is configured to be electrically connected to the mating member.

In certain embodiments, a projection of at least a portion of the connecting arm of the rear terminal group on a horizontal plane is located between projections of the two extending arms of the front terminal group on the horizontal plane.

In certain embodiments, the mating member presses downward on the first elastic arm, and the first elastic arm of the ground terminal of the rear terminal group abuts the first elastic arm of the ground terminal of the front terminal group.

In certain embodiments, at least one side of the first elastic arm of the rear terminal group is provided with an abutting portion to abut the ground terminal of the front terminal group to form an electrical connection therebetween.

In certain embodiments, two sides of the first elastic arm of the rear terminal group are respectively provided with two abutting portions to one-to-one correspondingly abut the two extending arms of the front terminal group.

In certain embodiments, the first base portion is provided with an opening slot, and the opening slot is in communication with the through slot.

In certain embodiments, two side plates are formed by respectively bending forward and extending from a left side and a right side of the first base portion, each of the two side plates is fixed with an insulating block, and in the same terminal group, the insulating blocks of the two side plates position the corresponding signal terminal.

In certain embodiments, each of the side plates is provided with at least one forming hole, and the insulating block is injection molded on a corresponding one of the two side plates and filled in the forming hole.

In certain embodiments, the two side plates of the ground terminal one-to-one correspondingly upward abut the two extending arms of the ground terminal.

In certain embodiments, the electrical connector further includes an insulating body, and the left side and the right side of the first base portion are fixed to the insulating body.

In certain embodiments, the ground terminal is provided with two first elastic arms, one of the two first elastic arms is formed by extending upward from an upper end of the first base portion to be electrically connected to the mating member, the other of the two first elastic arms is formed by extending downward from a lower end of the first base portion to be electrically connected to a circuit board, the signal terminal is provided with two second elastic arms, one of the two second elastic arms is formed by extending upward from an upper end of the second base portion to be electrically connected to the mating member, the other of the two second elastic arms is formed by extending downward from a lower end of the second base portion to be electrically connected to the circuit board, and in the same terminal group, the second elastic arm provided on the upper end of the second base portion passes upward through the through slot of the first elastic arm provided on the upper end of the first base portion, and the second elastic arm provided on the lower end of the second base portion passes downward through the through slot of the first elastic arm provided on the lower end of the first base portion.

In certain embodiments, the circuit board presses upward on the first elastic arm provided on the lower end of the first base portion, and the first elastic arm provided on the lower end of the first base portion of the rear terminal group abuts the ground terminal of the front terminal group to form an electrical connection therebetween.

Compared with the related art, in the electrical connector according to certain embodiments of the present invention, each of the terminal groups includes a ground terminal and a signal terminal, and in the same terminal group, the signal terminal is provided between the two extending arms of the corresponding ground terminal, such that the signal terminal is shielded by the two extending arms, which is equivalent to the signal terminal in each terminal group being correspondingly provided with a shielding member, increasing the shielding effect between the adjacent signal terminals. The mating member presses on the first elastic arm, and the first elastic arm of the ground terminal in the rear terminal group abuts the ground terminal of the front terminal group, such that the ground terminals of the two terminal groups provided adjacent in the front-rear direction are connected to each other and altogether grounded, thus reducing a potential difference between the ground terminals in the two terminal groups provided adjacent in the front-rear direction, achieving zero potential, and further increasing the shielding effect between the adjacent signal terminals.

To achieve the foregoing objective, another aspect of the present invention adopts the following technical solutions.

An electrical connector is configured to be electrically connected to a mating member. The electrical connector includes: two ground terminals provided to be adjacent in a front-rear direction, wherein each of the two ground terminals is provided with a first base portion and a first elastic arm formed by extending from the first base portion to be electrically connected to the mating member, the two first base portions of the two ground terminals are arranged in the front-rear direction, and the first elastic arm of the ground terminal located behind comprises two extending arms; and a signal terminal, configured to be electrically connected to the mating member, wherein the signal terminal is located between the two first base portions of the two ground terminals, and the signal terminal is located between the two extending arms; wherein the mating member presses on the first elastic arm, and the first elastic arm of the ground terminal located behind abuts the ground terminal located in front thereof to form an electrical connection therebetween.

In certain embodiments, the first elastic arm is provided with a first contact portion, the signal terminal is provided with a second contact portion, and the two first contact portions of the two ground terminals are both located in front of the second contact portion.

In certain embodiments, the first elastic arm of the ground terminal located behind is provided with at least one abutting portion to abut the ground terminal located in front thereof at an abutting location, and the abutting location is located behind the first contact portion of the ground terminal located behind and is located in front of the second contact portion.

In certain embodiments, the ground terminal located behind is provided with two first elastic arms, one of the two first elastic arms is formed by extending upward from an upper end of the first base portion of the ground terminal located behind to be electrically connected to the mating member, the other of the two first elastic arms is formed by extending downward from a lower end of the first base portion of the ground terminal located behind to be electrically connected to a circuit board, each of the two first elastic arms of the ground terminal located behind is provided with a through slot, and the through slot is located between the two extending arms of each of the two first elastic arms.

In certain embodiments, the first base portion of the ground terminal located behind is provided with an opening slot, and the opening slot is in communication with the two through slots of the two elastic arms of the ground terminal located behind.

In certain embodiments, the signal terminal comprises a second base portion and two second elastic arms formed by respectively extending from an upper end and a lower end of the second base portion, the second elastic arm provided on the upper end of the second base portion passes upward through the through slot of the first elastic arm provided on the upper end of the first base portion, and the second elastic arm provided on the lower end of the second base portion passes downward through the through slot of the first elastic arm provided on the lower end of the first base portion.

In certain embodiments, two side plates are formed by respectively bending forward and extending from a left side and a right side of the first base portion of the ground terminal located behind, and each of the side plates is provided between and abuts the two first elastic arms of the ground terminal located behind.

In certain embodiments, each of the two side plates is fixed with an insulating block, and the insulating blocks of the two side plates position the signal terminal.

In certain embodiments, the first elastic arm of each of the ground terminals comprises the two extending arms, the mating member presses on the first elastic arm, and the two extending arms of the ground terminal located behind one-to-one correspondingly abut the two extending arms of the ground terminal located in front thereof to form an electrical connection therebetween.

In certain embodiments, the two ground terminals adjacent in the front-rear direction are arranged to be staggered in a left-right direction, the mating member presses on the first elastic arm, and one of the two extending arms of the ground terminal located behind forward abuts the ground terminal located in front thereof to form an electrical connection therebetween.

Compared with the related art, in the electrical connector according to certain embodiments of the present invention, the signal terminal is provided between the two extending arms of the ground terminal located behind, which is equivalent to the signal terminal being shielded by the two extending arms, reducing the signal interference between the signal terminal and other adjacent signal terminals. Further, the signal terminal is located between the two first base portions, and the two first base portions further reduce the signal interference between the signal terminal and other adjacent signal terminals. The mating member presses on the first elastic arms, and the first elastic arm of the ground terminal located behind abuts the ground terminal located in front thereof, such that the two adjacent ground terminals in the front-rear direction are altogether grounded, thus reducing a potential difference between the two adjacent ground terminals in the front-rear direction, achieving zero potential, and further increasing the shielding effect between the adjacent signal terminals.

To achieve the foregoing objective, yet another aspect of the present invention adopts the following technical solutions.

An electrical connector assembly includes: an electrical connector, comprising two ground terminals and a signal terminal, the two ground terminals are arranged in a front-rear direction, each of the ground terminals is provided with a first base portion and a first elastic arm formed by extending from the first base portion, the first elastic arm of the ground terminal located behind comprises two extending arms, and the signal terminal is located between the two first base portions of the two ground terminals; and a mating connector mated with the electrical connector, the mating connector comprising a grounding conductor and a signal conductor, wherein the grounding conductor presses on the first elastic arm of the ground terminal located behind, the first elastic arm of the ground terminal located behind abuts the ground terminal located in front thereof to form an electrical connection therebetween, the signal conductor is located between the two extending arm and is in contact with the signal terminal to form an electrical connection therebetween.

In certain embodiments, the first elastic arm of the ground terminal located behind has a connecting arm, an end of each of the two extending arms located away from the first base portion is connected to the connecting arm, and the connecting arm of the ground terminal located behind abuts the ground terminal located in front thereof.

In certain embodiments, the connecting arm has an abutting portion formed by bending upward from an end of the connecting arm located away from the two extending arms, and the abutting portion abuts the first elastic arm of the ground terminal located in front thereof to form an electrical connection therebetween.

In certain embodiments, the grounding conductor presses the two extending arms downward to form an electrical connection therebetween.

In certain embodiments, a contact location of the signal conductor and the signal terminal is located below the extending arms.

In certain embodiments, the grounding conductor is in a tubular shape and is surroundingly provided outside the signal conductor, and the signal conductor protrudes downward out of the grounding conductor.

In certain embodiments, the mating connector further comprises an coaxial cable, the coaxial cable comprises a wire, a shielding layer, an insulating layer provided between the wire and the shielding layer, and an insulating skin covering outside the shielding layer, the wire is connected to the signal conductor, and the shielding layer is connected to the grounding conductor.

In certain embodiments, a hardness of the signal conductor is greater than a hardness of the wire, the mating connector comprises an insulating fixing member fixing the signal conductor and the wire, and the insulating fixing member is located between the grounding conductor and the signal conductor.

In certain embodiments, the signal terminal comprises a second base portion and two second elastic arms formed by extending upward from the second base portion, and the signal conductor is provided to be clamped between the two second elastic arms to be electrically connected to the signal terminal.

In certain embodiments, the two extending arms are located on a same horizontal plane.

Compared with the related art, in the electrical connector assembly according to certain embodiments of the present invention, the signal terminal is located between the two first base portions of the two ground terminals, and the two first base portions shield the signal terminal, reducing the signal interference between the signal terminal and other adjacent signal terminals. The grounding conductor presses on the first elastic arm of the ground terminal located behind, and the first elastic arm of the ground terminal located behind abuts the ground terminal located in front thereof, such that the two ground terminals arranged in the front-rear direction are altogether grounded, thus reducing a potential difference between the two ground terminals arranged in the front-rear direction, achieving zero potential, and further reducing the signal interference between the signal terminal and other adjacent signal terminals. Further, the signal conductor of the mating connector is located between the two extending arms, such that the two extending arms of the ground terminal located behind of the electrical connector further shield the signal conductor of the mating connector. Thus, the ground terminal located behind of the electrical connector shields not only the signal terminal of the electrical connector but also the signal conductor of the mating connector, enhancing the utilization rate of the ground terminal located behind.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
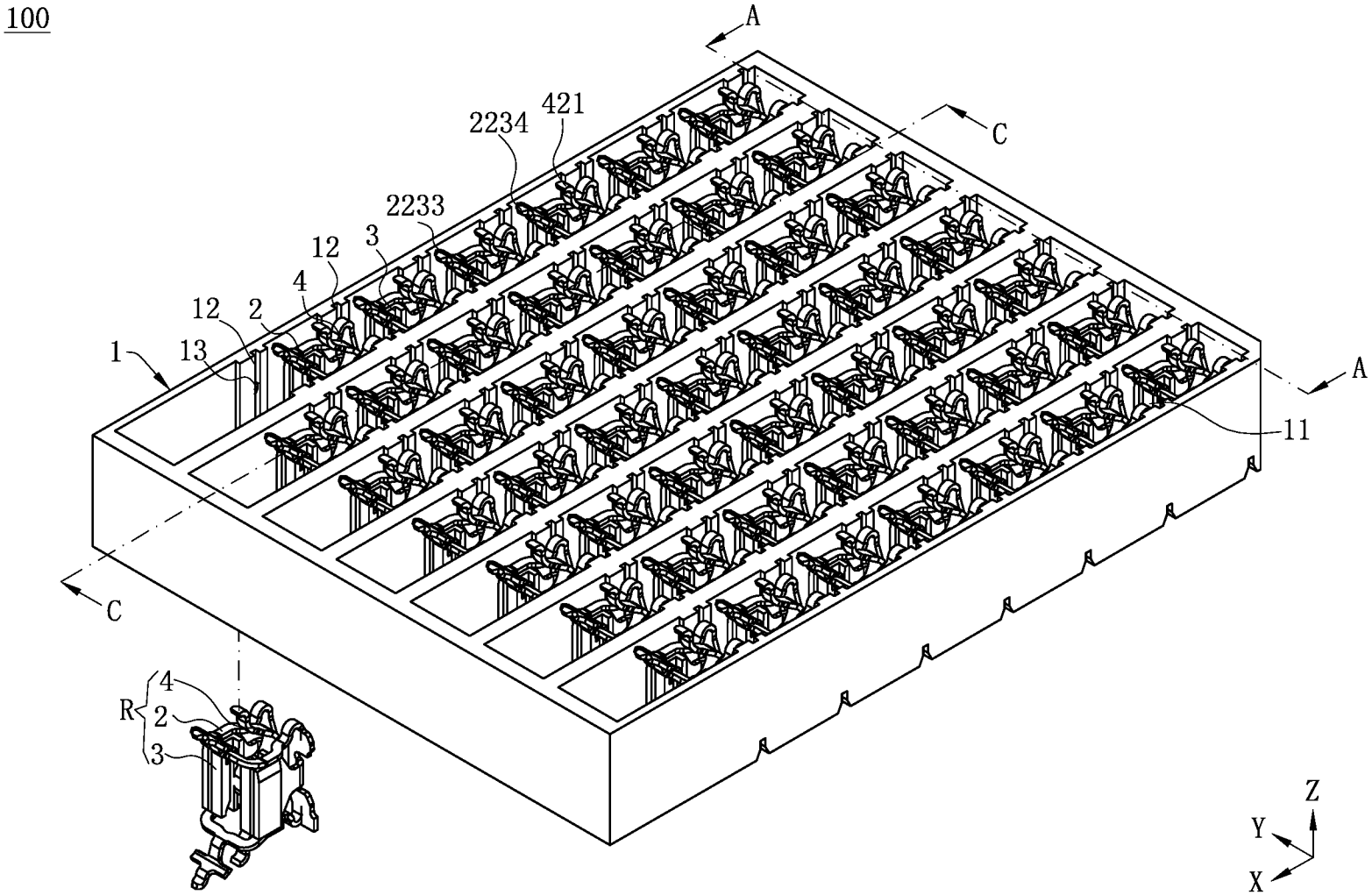
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-18. In accordance with the purposes of this invention, as embodied and broadly described herein, this invention, in one aspect, relates to an electrical connector and an electrical connector assembly.

In certain embodiments of the present invention, a forward direction in a front-rear direction is defined as the positive direction of the X-axis, a rightward direction in a left-right direction is defined as the positive direction of the Y-axis, and an upward direction in a vertical direction is defined as the positive direction of the Z-axis.

FIG. 1 to FIG. 12 show an electrical connector according to a first embodiment of the present invention. The electrical connector 100 is used to electrically connect a mating member 500 and a circuit board 600 (specifically referring to FIG. 11), in which the mating member 500 is provided above the electrical connector 100 and is used to press downward on the electrical connector 100, and the circuit board 600 is provided below the electrical connector 100 and is used to press upward on the electrical connector 100. Specifically, in this embodiment, the mating member 500 is a chip module.

Figure 9:
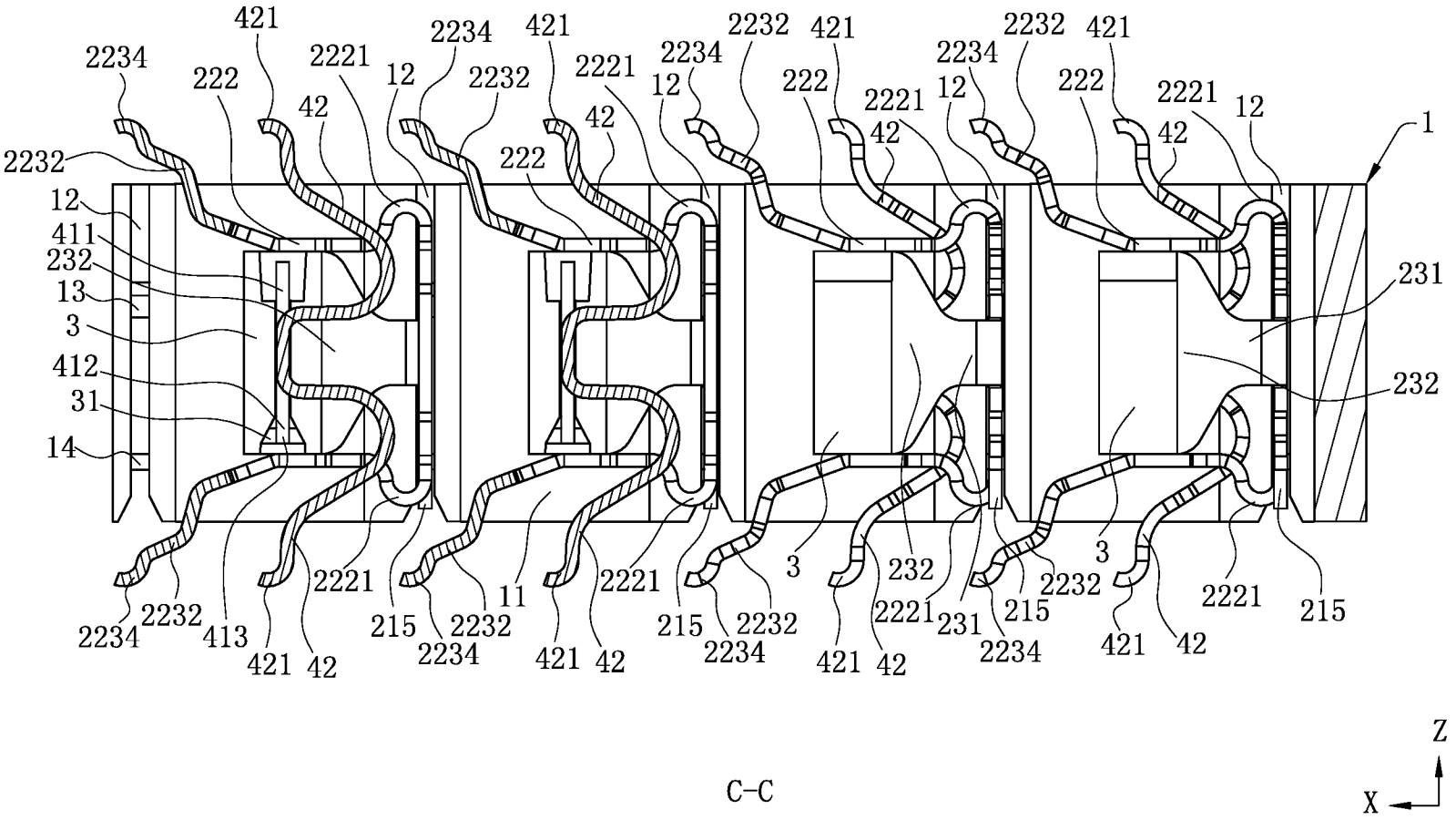
FIG. 9 is a partial sectional view of FIG. 1 sectioned along a line C-C.

As shown in FIG. 1 and FIG. 9, the electrical connector 100 includes an insulating body 1 and a plurality of terminal groups R mounted in the insulating body 1. The terminal groups R are provided in a plurality of rows in the left-right direction, and each row is provided with multiple terminal groups R arranged in the front-rear direction. The insulating body 1 is provided with a plurality of accommodating channels 11 provided at intervals in the left-right direction. Each accommodating channel 11 extends along the front-rear direction and runs vertically through the insulating body 1. Each accommodating channel 11 accommodates one row of the terminal groups R. In a same accommodating channel 11, the terminal groups R are provided at intervals along the front-rear direction. In this embodiment, the terminal groups R are assembled into the insulating body 1 upward from bottom thereof.

Figure 5:
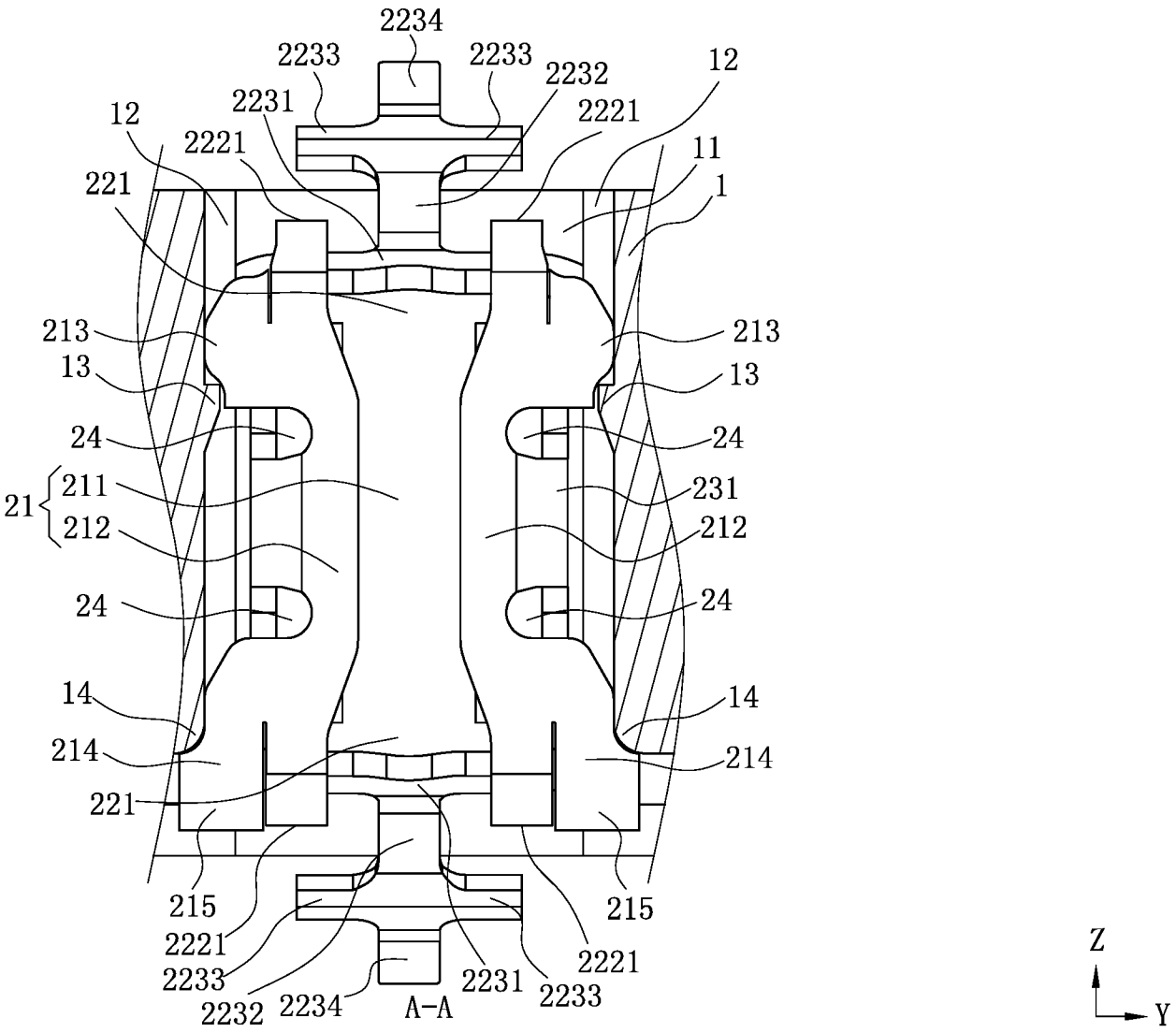
FIG. 5 is a partial sectional view of FIG. 1 sectioned along a line A-A.
Figure 8:
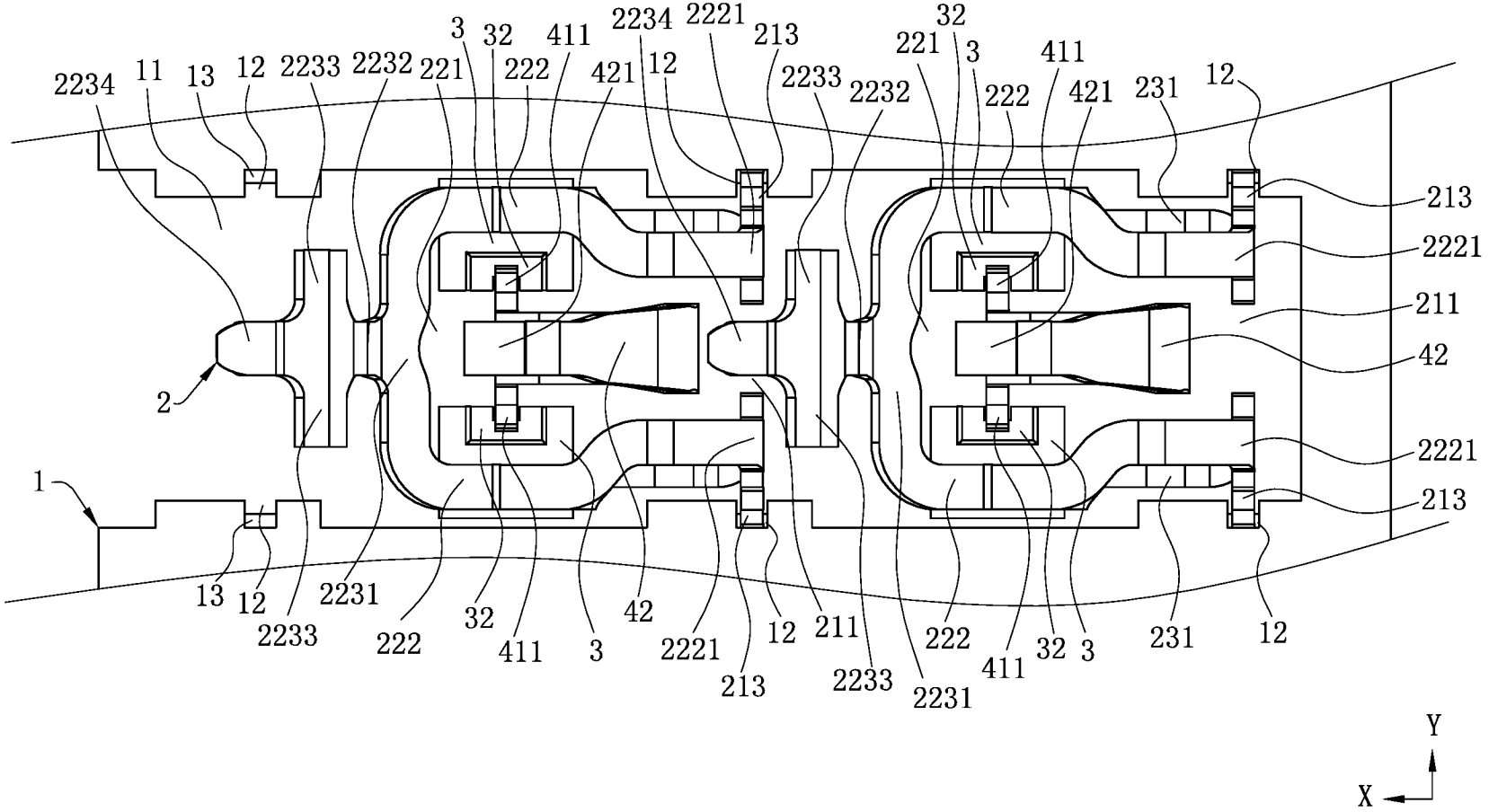
FIG. 8 is a partial top view of FIG. 1.

As shown in FIG. 1, FIG. 5 and FIG. 8, a plurality of fixing slots 12 are concavely provided at a left side and a right side of each accommodating channel 11. The fixing slots 12 located at the left side or the right side are provided at intervals along the front-rear directions, and the fixing slots 12 located at the left side and the fixing slots 12 located at the right side are one-to-one opposite to each other along the left-right direction. For each accommodating channel 11, each pair of the fixing slots 12 opposite to each other along the left-right direction are used to fix a corresponding terminal group R.

As shown in FIG. 5, each fixing slot 12 is provided with an upper blocking portion 13 and a lower blocking portion 14. The upper blocking portion 13 is located above the lower blocking portion 14 in the vertical direction. The upper blocking portion 13 is a protrusion protruding toward the corresponding accommodating channel 11 along the left-right direction. The upper blocking portion 13 is located below an upper surface of the insulating body 1 in the vertical direction. The lower blocking portion 14 is an end portion of the fixing slot 12 close to a lower surface of the insulating body 1. The lower blocking portion 14 is located above the lower surface of the insulating body 1 in the vertical direction.

Figure 2:
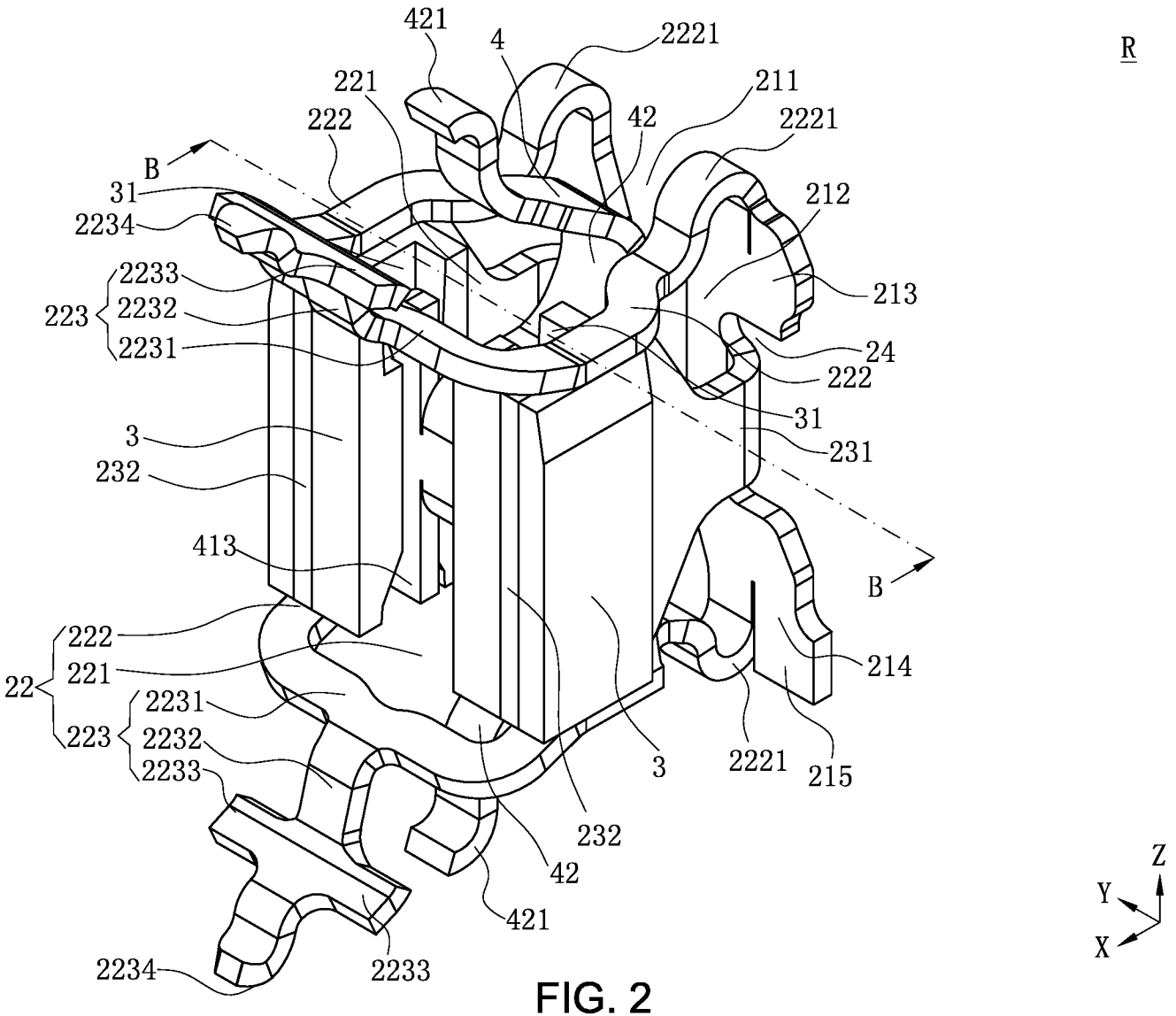
FIG. 2 is an enlarged view of the terminal groups in FIG. 1.

As shown in FIG. 1 and FIG. 2, each terminal group R includes a ground terminal 2, two insulating blocks 3 fixed to the ground terminal 2, and a signal terminal 4 fixed between the two insulating blocks 3. The ground terminal 2 is surroundingly provided outside the signal terminal 4. Specifically, in this embodiment, the insulating blocks 3 are fixed to the ground terminal 2 by injection molding.

Figure 3:
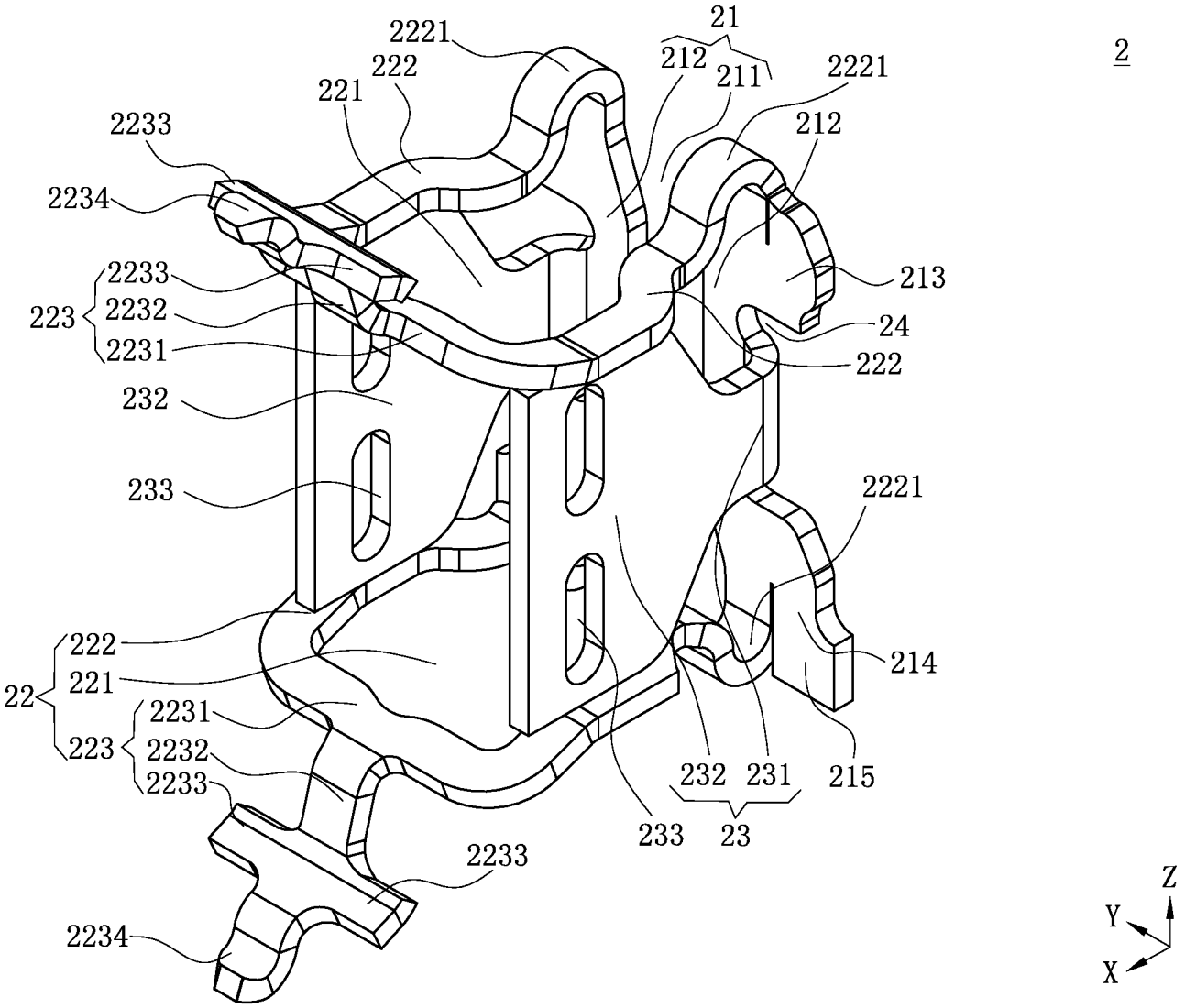
FIG. 3 is a schematic view of the ground terminal in FIG. 2.
Figure 4:
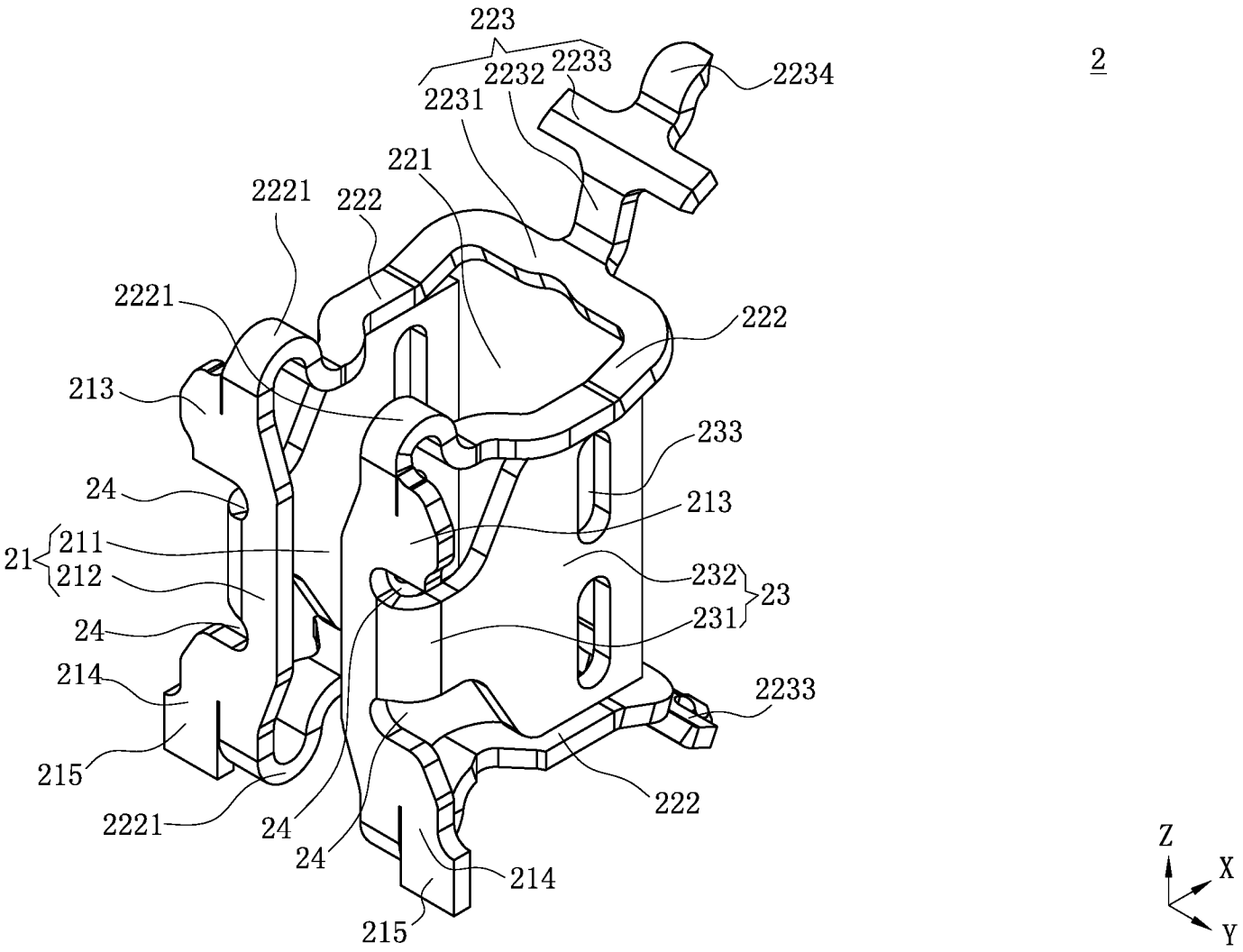
FIG. 4 is a schematic view of the ground terminal in FIG. 3 being 180° horizontally inversed.

As shown in FIG. 3, FIG. 4 and FIG. 9, the ground terminal 2 includes a first base portion 21, two first elastic arms 22 formed by extending from an upper end and a lower end of the first base portion 21, and two side plates 23 formed by bending forward and extending from a left side and a right side of the first base portion 21. One of the two first elastic arms 22 is formed by extending upward from the upper end of the first base portion 21, and the other of the two first elastic arms 22 is formed by extending downward from the lower end of the first base portion 21. The two first elastic arms 22 are both formed by bending forward and extending, and the two first elastic arms 22 are provided opposite to each other. An upper end and a lower end of each of the two side plates 23 respectively abut the two first elastic arms 22.

As shown in FIG. 3, FIG. 4 and FIG. 5, the first base portion 21 includes an opening slot 211 and two retaining plates 212 provided at a left side and a right side of the opening slot 211. Each retaining plate 212 includes an upper stopping portion 213 and a lower stopping portion 214. The upper stopping portion 213 is located above the lower stopping portion 214 in the vertical direction. The upper stopping portion 213 and the lower stopping portion 214 are both formed by protruding toward a side away from the opening slot 211. The lower stopping portion 214 protrudes more than the upper stopping portion 213 toward the side away from the opening slot 211. The upper stopping portion 213 is located at an upper end of each retaining plate 212, and the lower stopping portion 214 is located at a lower end of each retaining plate 212. The lower end of each retaining plate 212 is further provided with a first strip connecting portion 215 to be connected to a strip. Specifically, the first strip connecting portion 215 is provided below and is connected to the lower stopping portion 214 of the same retaining plate 212.

As shown in FIG. 3 and FIG. 4, each of the first elastic arms 22 includes a through slot 221, two extending arms 222 provided at a left side and a right side of the through slot 221, and a connecting arm 223 connecting the two extending arms 222.

As shown in FIG. 3 and FIG. 4, the two through slots 221 of the two first elastic arms 22 are provided opposite to each other in the vertical direction, and the two through slots 221 are respectively in communication with the opening slot 211. That is, the two through slots 221 are in communication with each other by the opening slot 211.

As shown in FIG. 3, FIG. 4 and FIG. 9, the two extending arms 222 located on the upper end of the first base portion 21 are formed by bending and extending upward and forward from upper ends of the two retaining plates 212, and the two extending arms 222 located on the lower end of the first base portion 21 are formed by bending and extending downward and forward from lower ends of the two retaining plates 212. That is, one extending arm 222 is formed by extending from each of the upper end and the lower end of each of the retaining plates 212. An end portion of each extending arm 222 close to the first base portion 21 is provided with a bent portion 2221. The two extending arms 222 of a same first elastic arm 22 one-to-one correspondingly upward or downward abut the two side plates 23 respectively to shorten the backflow path between the two first elastic arms 22.

As shown in FIG. 3 and FIG. 4, in the same first elastic arm 22, the connecting arm 223 is connected to the two extending arms 222 at the ends of the two extending arms 222 away from the first base portion 21. The connecting arm 223 includes a lateral beam 2231 used to connect the two extending arms 222, a longitudinal beam 2232 formed by extending toward a side away from the extending arms 222 from the lateral beam 2231, and two abutting portions 2233 formed by respectively protruding from a left side and a right side of the longitudinal beam 2232. The lateral beam 2231 and the longitudinal beam 2232 form a T-shaped structure. An end portion of the longitudinal beam 2232 away from the extending arms 222 is provided with a first contact portion 2234 to be in contact with the mating member 500 or the circuit board 600, and to form an electrical connection with the mating member 500 or the circuit board 600. The abutting portions 2233 are used to abut the ground terminal 2 located in front thereof. In other embodiments, the connecting arm 223 may be provided with only one abutting portion 2233 protruding from one of the left side and the right side of the longitudinal beam 2232.

Figure 7:
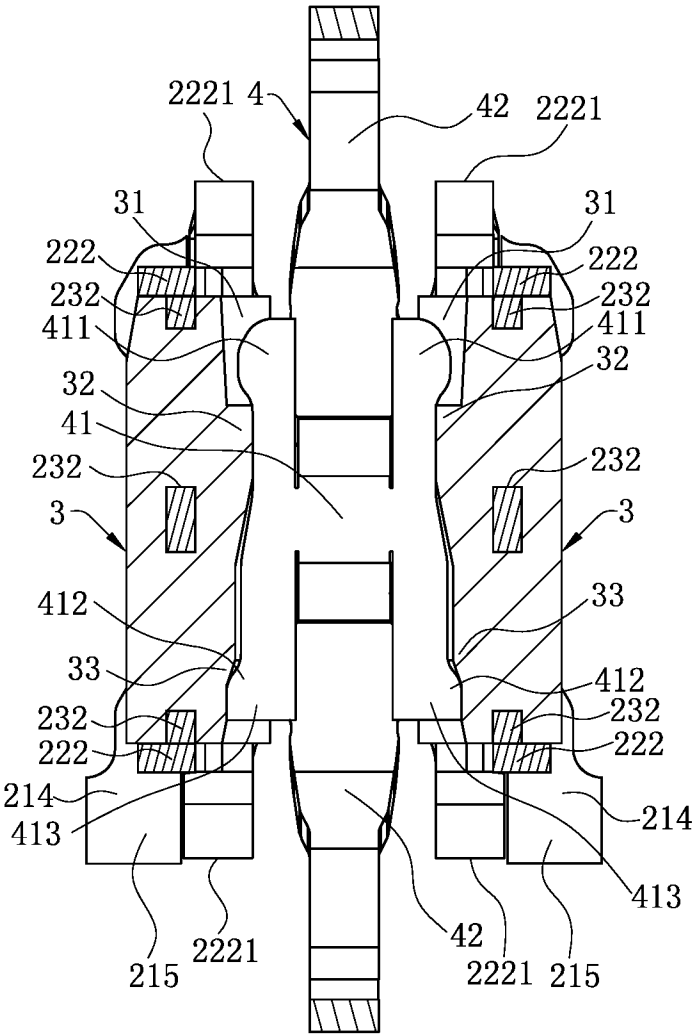
FIG. 7 is a sectional view of FIG. 2 sectioned along a line B-B.

As shown in FIG. 3, FIG. 4 and FIG. 7, each side plate 23 includes a bending portion 231 and a flat plate portion 232 connected to each other along the front-rear direction. The bending portion 231 is used to be connected to the corresponding retaining plate 212, such that the corresponding side plate 23 bends forward. The bending portion 231 is located between the upper stopping portion 213 and the lower stopping portion 214 of the corresponding retaining plate 212 in the vertical direction. The flat plate portion 232 is provided at an end of the bending portion 231 away from the first base portion 21, and respectively abuts the two first elastic arms 22. Specifically, the flat plate portion 232 abuts the two extending arms 222 of the two elastic arms 22 located at a same side in the left-right direction. Each flat plate portion 232 is provided with at least one forming hole 233 to be filled by an insulating material running therethrough in order to form the corresponding insulating block 3 by injection molding. In this embodiment, each flat plate portion 232 is provided with two forming holes 233.

As shown in FIG. 3 and FIG. 4, in a same retaining plate 212, two processing slots 24 formed by punching are provided between the bending portion 231 and the upper stopping portion 213 above the bending portion 231 and between the bending portion 231 and the lower stopping portion 214 below the bending portion 231, allowing the side plate 23 to bend forward.

As shown in FIG. 2 and FIG. 7, the two insulating blocks 3 are one-to-one correspondingly injection molded on the two flat plate portions 232, and the two insulating blocks 3 are provided opposite to each other at an interval along the left-right direction. The two through slots 221 are in communication through a gap between the two insulating blocks 3. Two positioning slots 31 are concavely provided respectively on the side surfaces of the two insulating blocks 3 facing each other. Each positioning slot 31 is provided with an upper position stopping portion 32 and a lower position stopping portion 33. The upper position stopping portion 32 is located above the lower position stopping portion 33 in the vertical direction. The upper position stopping portion 32 is provided lower than the upper surface of each insulating block 3, and the lower position stopping portion 33 is provided higher than the lower surface of each insulating block 3. Specifically, the upper position stopping portion 32 and the lower position stopping portion 33 of each insulating block 3 are protrusions formed by protruding from the slot wall of the corresponding positioning slot 31 toward the other insulating block 3, and the upper position stopping portion 32 and the lower position stopping portion 33 are connected to each other along the vertical direction.

Figure 6:
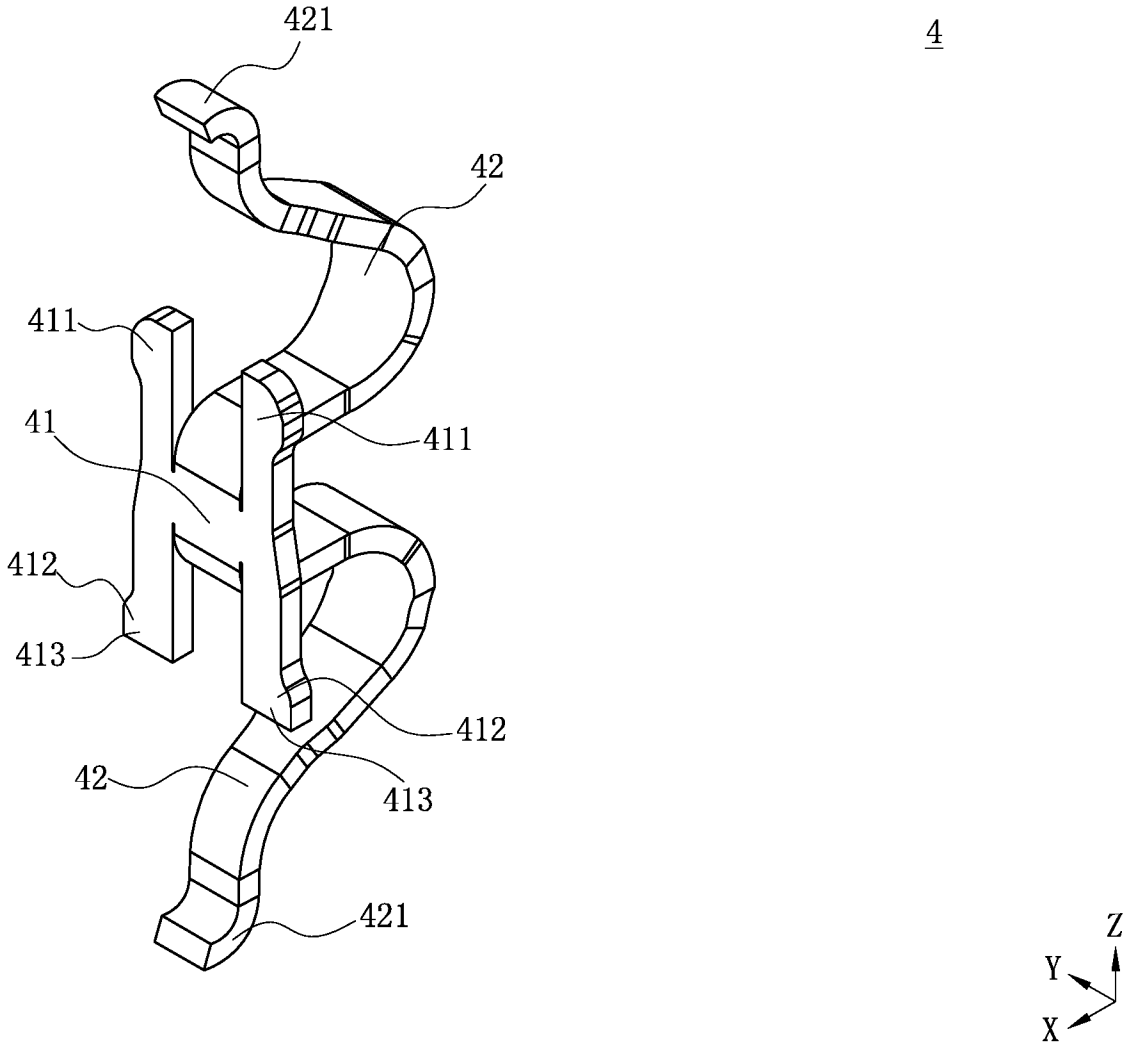
FIG. 6 is a schematic view of the signal terminal in FIG. 2.

As shown in FIG. 6 and FIG. 9, each signal terminal 4 includes a second base portion 41 and two second elastic arms 42 formed by extending from an upper end and a lower end of the second base portion 41. One of the second elastic arms 42 is formed by extending upward from the upper end of the second base portion 41, and the other of the second elastic arms 42 is formed by extending downward from the lower end of the second base portion 41. The two second elastic arms 42 are provided opposite to each other vertically. Each second elastic arm 42 is provided with a second contact portion 421 to be in contact with the mating member 500 or the circuit board 600 in order to form an electrical connection with the mating member 500 or the circuit board 600.

As shown in FIG. 6, two upper position limiting portions 411 are respectively provided at a left side and a right side of the second base portion 41, and two lower position limiting portions 412 are respectively provided at the left side and the right side of the second base portion 41. Each upper position limiting portion 411 is provided above the lower position limiting portion 412 at the same side of the second base portion 41 in the vertical direction. The upper position limiting portions 411 and the lower position limiting portions 412 are all protrusions formed by protruding outward. Each lower position limiting portions 412 extends downward to form a second strip connecting portion 413 for connecting to another strip.

As shown in FIG. 2, FIG. 7 and FIG. 8, in the same terminal group R, the second base portion 41 is provided between the two insulating blocks 3, the upper position limiting portions 411 downward abut the upper position stopping portions 32, and the lower position limiting portions 412 upward abut the lower position stopping portions 33, thus fixing the signal terminal 4 in the two insulating blocks 3. The second elastic arm 42 on the upper end of the second base portion 41 passes upward through the through slot 221 on the upper end of the first base portion 21, and the second elastic arm 42 on the lower end of the second base portion 41 passes downward through the through slot 221 on the lower end of the first base portion 21, thus limiting the signal terminal 4 between the two extending arms 222 on the upper end of the first base portion 21 and between the two extending arms 222 on the lower end of the first base portion 21. Further, the signal terminal 4 as a whole is provided in front of the first base portion 21, and the second contact portion 421 is located behind the first contact portion 2234. Specifically, the second contact portion 421 is located behind the lateral beam 2231. Thus, in the same terminal group R, the signal terminal 4 is surrounded by the ground terminal 2.

Figure 10:
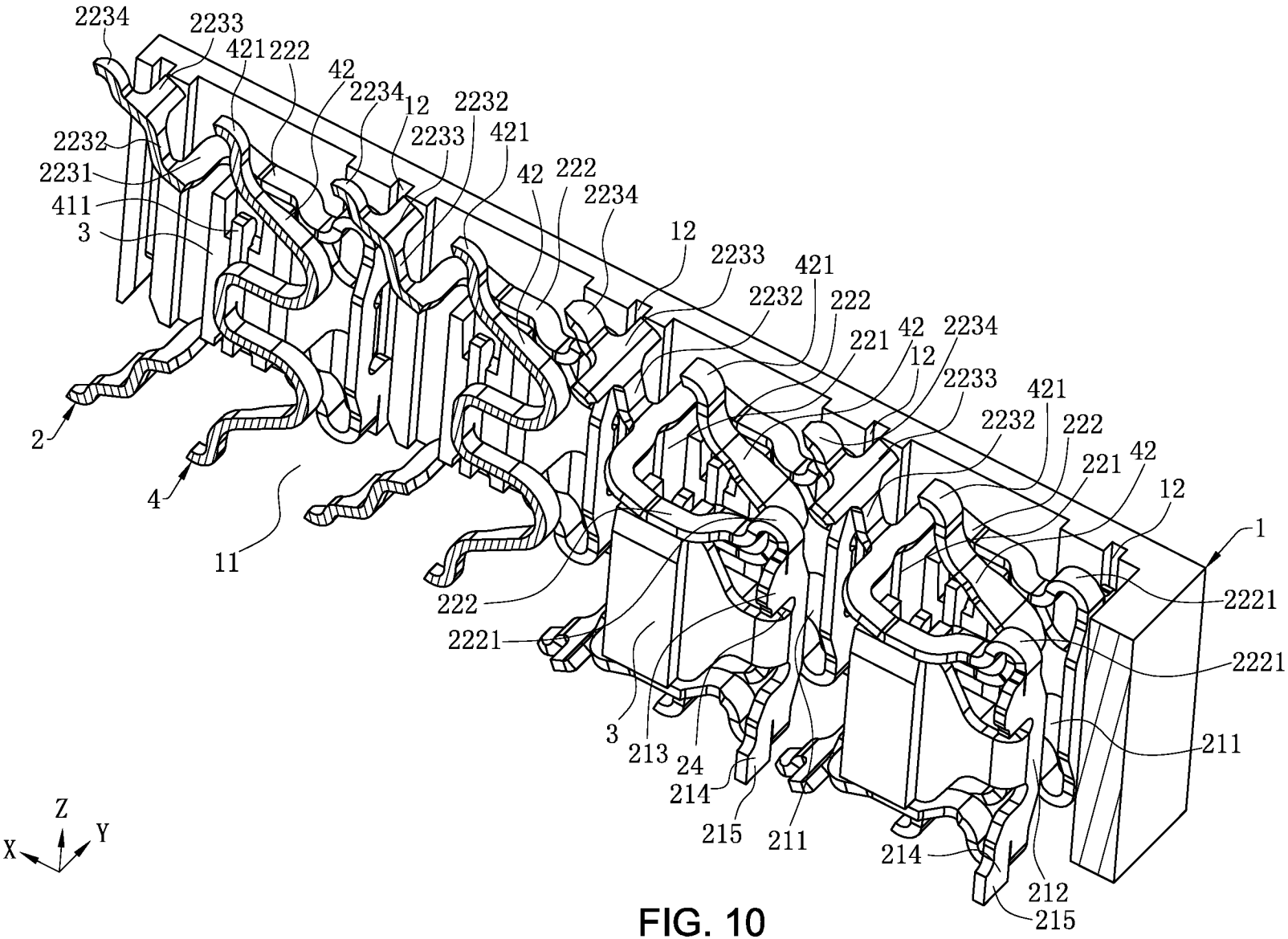
FIG. 10 is a perspective view of FIG. 9.

As shown in FIG. 8 and FIG. 10, in the same terminal group R, the two second elastic arms 42 are provided opposite to the opening slot 211 in the front-rear direction.

As shown in FIG. 2, FIG. 5 and FIG. 8, the same terminal group R is fixed to the insulating body 1 by the first base portion 21 of the ground terminal 2. Specifically, the two retaining plates 212 located at the left side and the right side of the opening slot 211 are one-to-one correspondingly engaged into the two opposite fixing slots 12 in the left-right direction of the corresponding accommodating channel 11. The upper stopping portions 213 downward abut the corresponding upper blocking portions 13, and the lower stopping portions 214 upward abut the corresponding lower blocking portions 14, such that the ground terminal 2 is positioned in the insulating body 1, and does not detach upward or downward from the insulating body 1.

As shown in FIG. 5, the ground terminal 2 is mounted into the insulating body 1 upward from bottom thereof. The opening slot 211 provided between the two retaining plates 212 provides a deformation space for the ground terminal 2, which is convenient for mounting.

As shown in FIG. 8 and FIG. 9, the terminal groups R accommodated in the same accommodating channel 11 are provided to be arranged along the front-rear direction. The first contact portions 2234 and the second contact portions 421 are provided alternately along the front-rear direction, and the first contact portions 2234 and the second contact portions 421 are located on a same straight line along the front-rear direction. In two adjacent terminal groups R along the front-rear direction, the terminal group R located in front thereof is defined as a front terminal group, and the other terminal group R is defined as a rear terminal group. In a top view, a projection of the longitudinal beam 2232 of the rear terminal group on a horizontal plane is provided between the projections of the two extending arms 222 of the front terminal group on the horizontal plane. The signal terminal 4 of the rear terminal group is located between the first base portion 21 of the rear terminal group and the first base portion 21 of the front terminal group.

Figure 11:
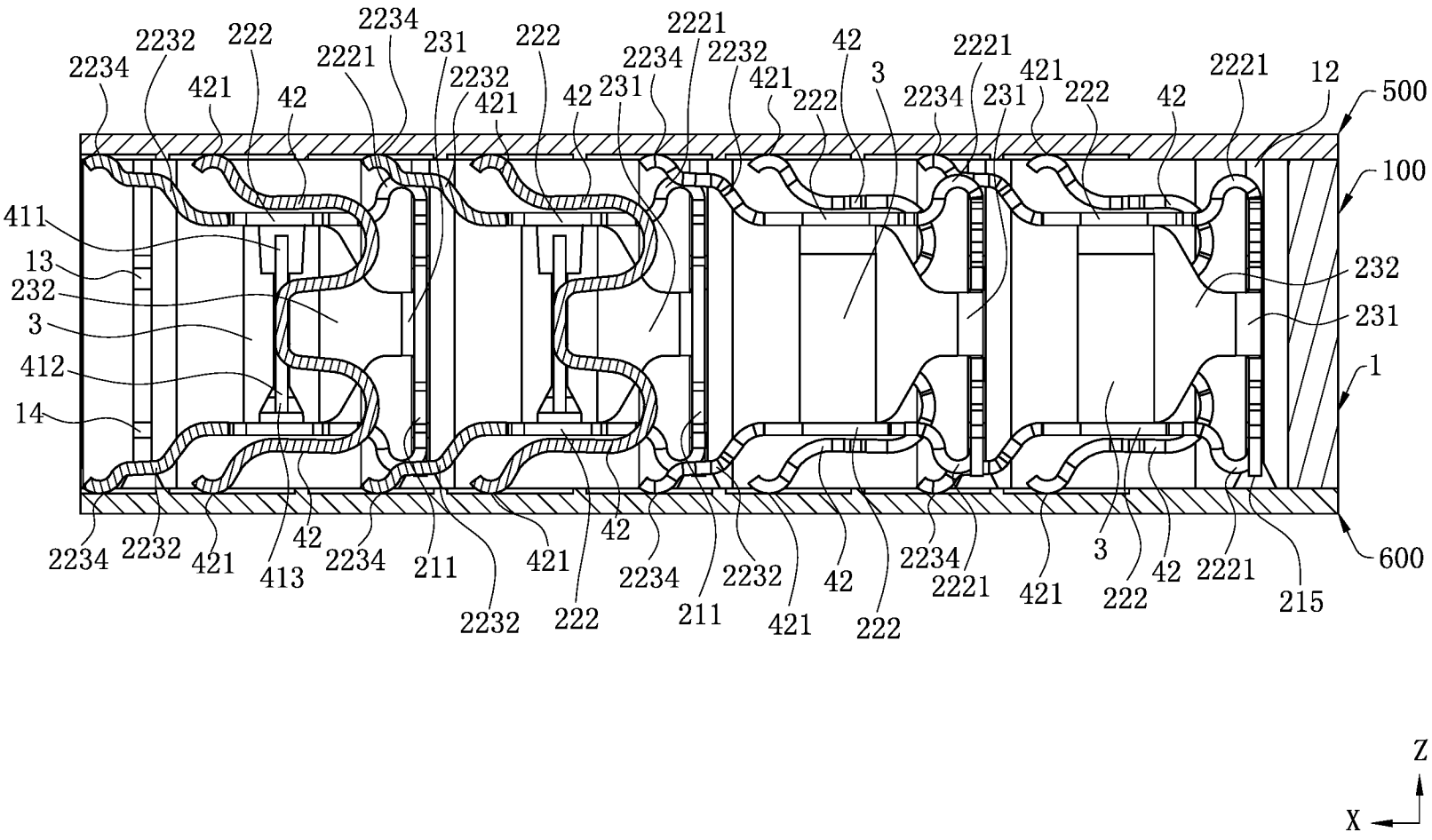
FIG. 11 is a schematic view of the electrical connector in FIG. 9 after being pressed by the chip module and the circuit board.
Figure 12:
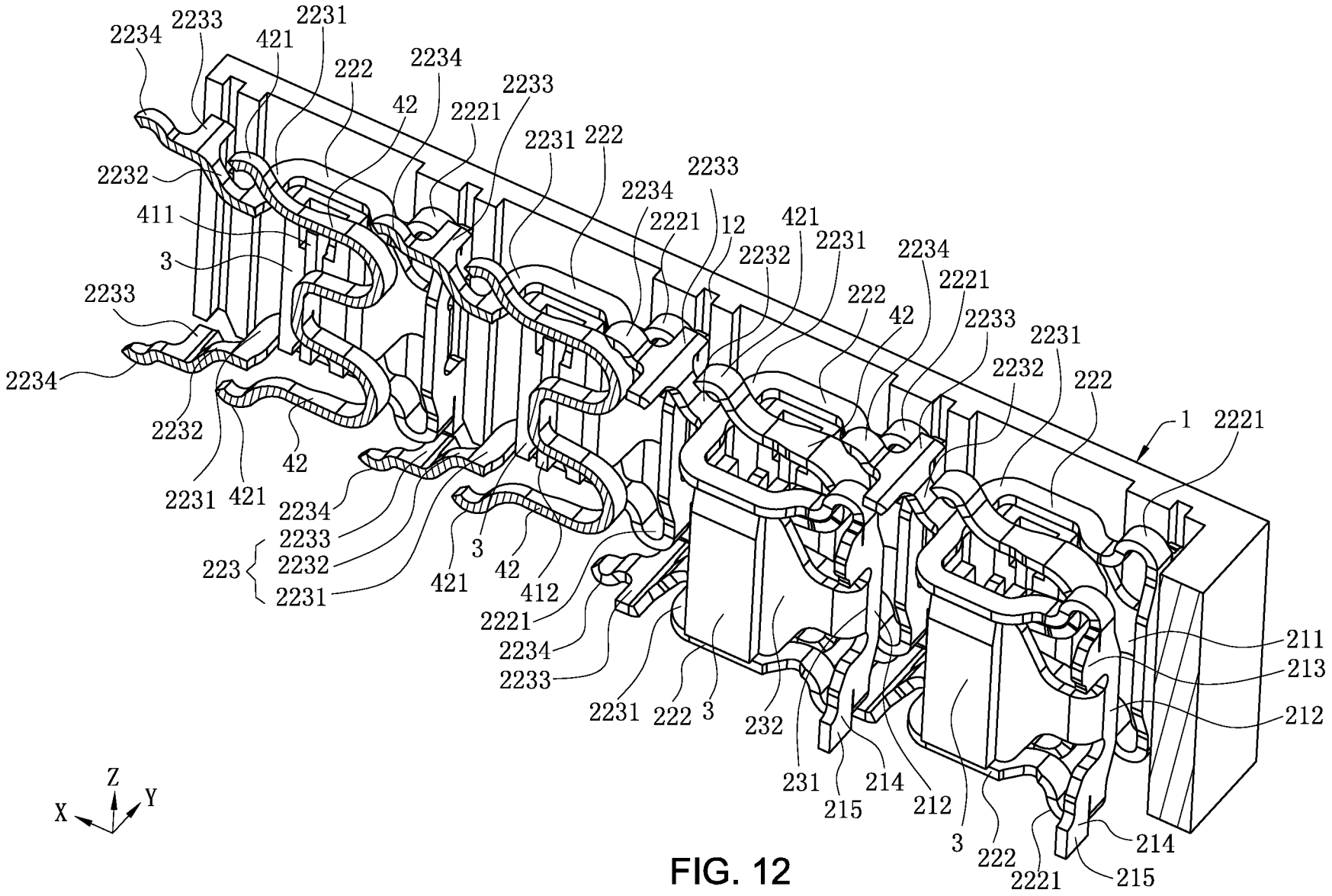
FIG. 12 is a perspective view of the electrical connector in FIG. 11 after being pressed.

As shown in FIG. 10, FIG. 11 and FIG. 12, the mating member 500 presses downward on the electrical connector 100, and the circuit board 600 presses upward on the electrical connector 100. The first elastic arm 22 on the upper end of the first base portion 21 of the rear terminal group forward abuts the first elastic arm 22 on the upper end of the first base portion 21 of the front terminal group, and the first elastic arm 22 on the lower end of the first base portion 21 of the rear terminal group forward abuts the first elastic arm 22 on the lower end of the first base portion 21 of the front terminal group. Specifically, the two abutting portions 2233 on the upper end of the first base portion 21 of the rear terminal group one-to-one correspondingly forward abut the two bent portions 2221 of the two extending arms 222 on the upper end of the first base portion 21 of the front terminal group, and the two abutting portions 2233 on the lower end of the first base portion 21 of the rear terminal group one-to-one correspondingly forward abut the two bent portions 2221 of the two extending arms 222 on the lower end of the first base portion 21 of the front terminal group, such that the ground terminals 2 in the same accommodating channel 11 are altogether grounded, thus reducing a potential difference between the ground terminals 2 in the same accommodating channel 11. The best effect would be achieving zero potential.

Figure 13:
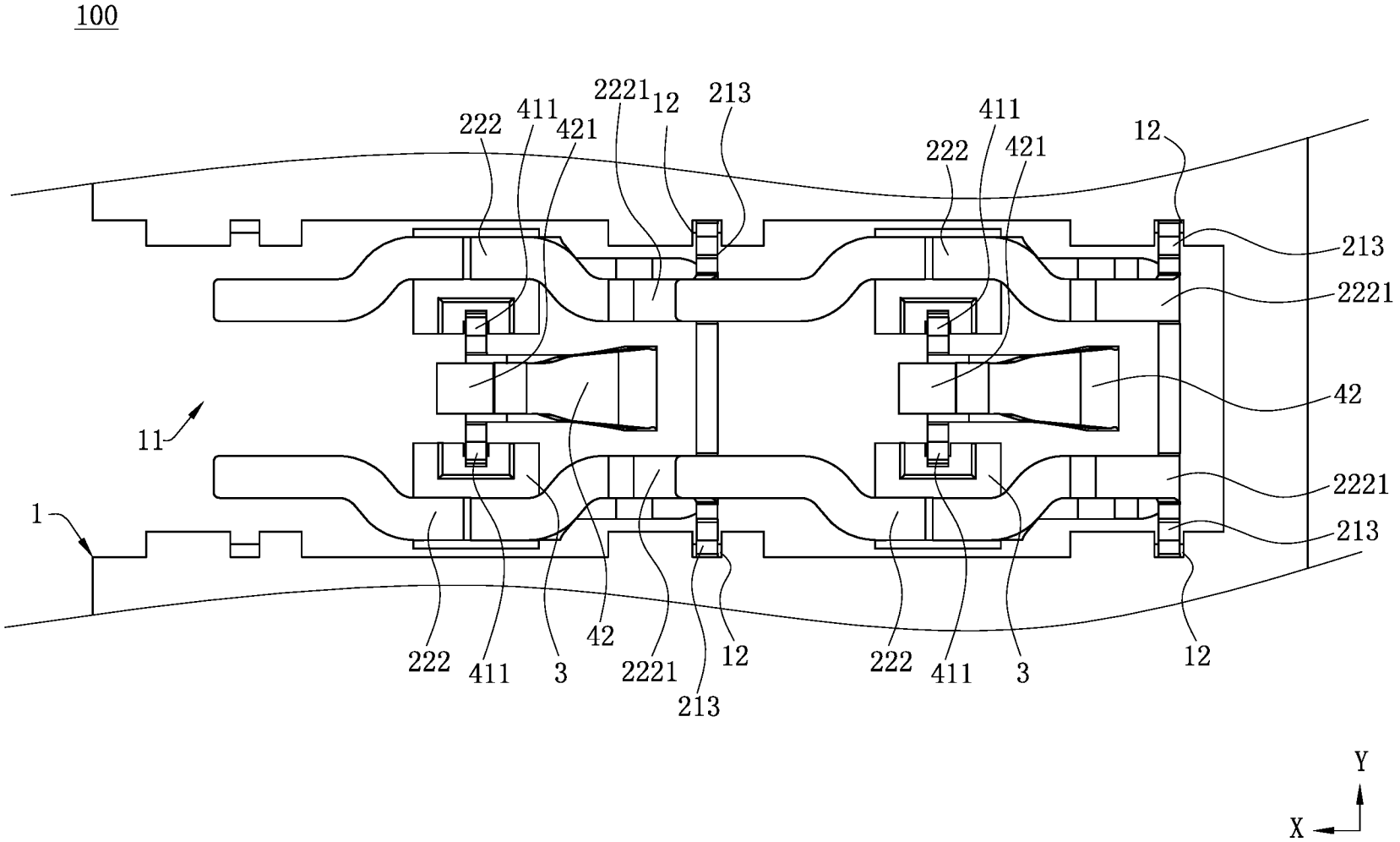
FIG. 13 is a partial top view of an electrical connector according to a second embodiment of the present invention, after being pressed by the chip module and the circuit board, where the chip module and the circuit board are hidden.

FIG. 13 show an electrical connector according to a second embodiment of the present invention, which is different from the electrical connector 100 according to the first embodiment of the present invention in that: each first elastic arm 22 of the ground terminal 2 includes only two extending arms 222, and the ends of the two extending arms 222 away from the first base portion 21 are provided to be separate from each other, i.e., breaking from each other. When each first elastic arm 22 of each ground terminal 2 is pressed, the two extending arms 222 on the upper end of the first base portion 21 of the terminal group R located behind one-to-one correspondingly forward abut the two bent portions 2221 of the two extending arms 222 on the upper end of the first base portion of the terminal group R located in front thereof, and the two extending arms 222 on the lower end of the first base portion 21 of the terminal group R located behind one-to-one correspondingly forward abut the two bent portions 2221 of the two extending arms 222 on the lower end of the first base portion of the terminal group R located in front thereof, such that the ground terminals 2 in the same accommodating channel 11 are altogether grounded. Other structures in this embodiment are identical to those in the first embodiment, and are thus not further elaborated herein.

Figure 14:
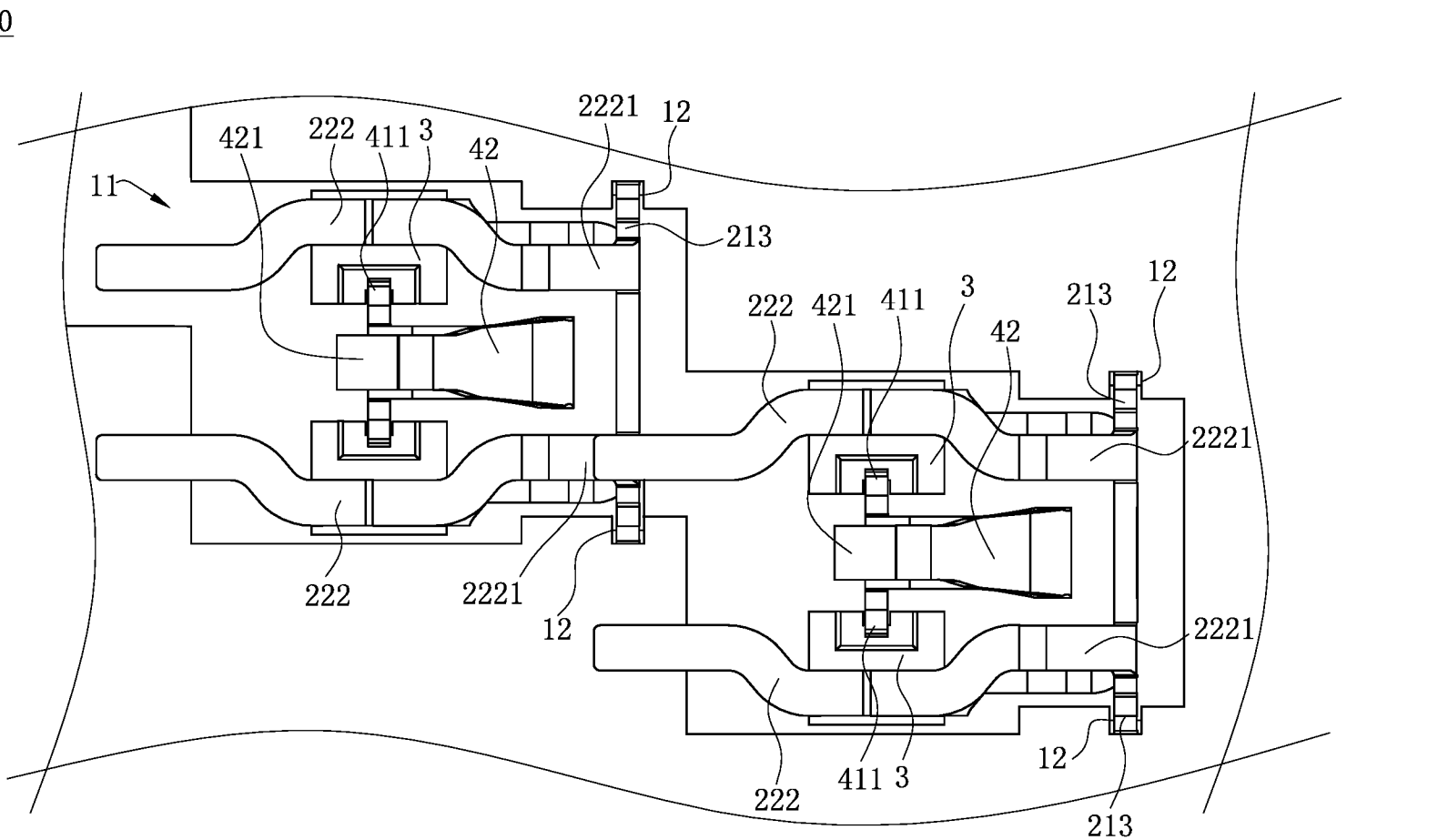
FIG. 14 is a partial top view of an electrical connector according to a third embodiment of the present invention, after being pressed by the chip module and the circuit board, where the chip module and the circuit board are hidden.

FIG. 14 show an electrical connector according to a third embodiment of the present invention, which is different from the electrical connector 100 according to the second embodiment of the present invention in that: the two adjacent terminal groups R in the front-rear direction are provided to be staggered in the left-right direction. When each first elastic arm 22 of each ground terminal 2 is pressed, only one extending arm 222 in each of the upper end and the lower end of the first base portion 21 of the terminal group R located behind forward abuts the ground terminal 2 of the terminal group R located in front thereof. Specifically, the extending arm 222 located at the right side on the upper end of the first base portion 21 of the terminal group R located behind forward abuts the bent portion 2221 of the extending arm 222 located at the left side on the upper end of the first base portion 21 of the terminal group R in front thereof, and the extending arm 222 located at the right side on the lower end of the first base portion 21 of the terminal group R located behind forward abuts the bent portion 2221 of the extending arm 222 located at the left side on the lower end of the first base portion 21 of the terminal group R in front thereof, such that the two ground terminals 2 of the two terminal groups R arranged to be staggered in the left-right direction are altogether grounded. Other structures in this embodiment are identical to those in the second embodiment, and are thus not further elaborated herein.

FIG. 15 to FIG. 18 show an electrical connector assembly according to certain embodiments of the present invention. The electrical connector assembly includes an electrical connector 100' and a mating connector 400' mated with the electrical connector 100'.

Figure 16:
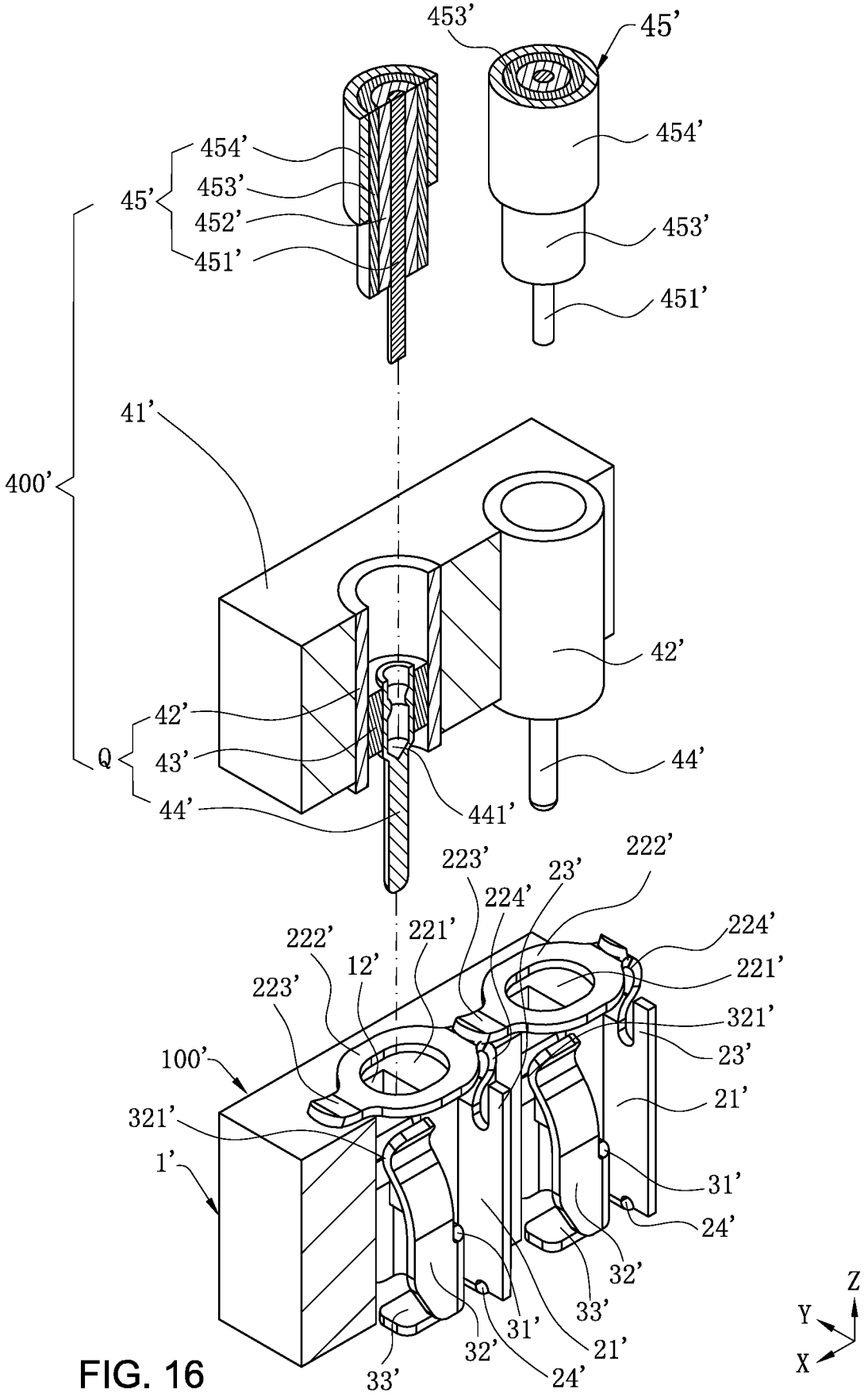
FIG. 16 is a partial exploded sectional view of FIG. 15.
Figure 18:
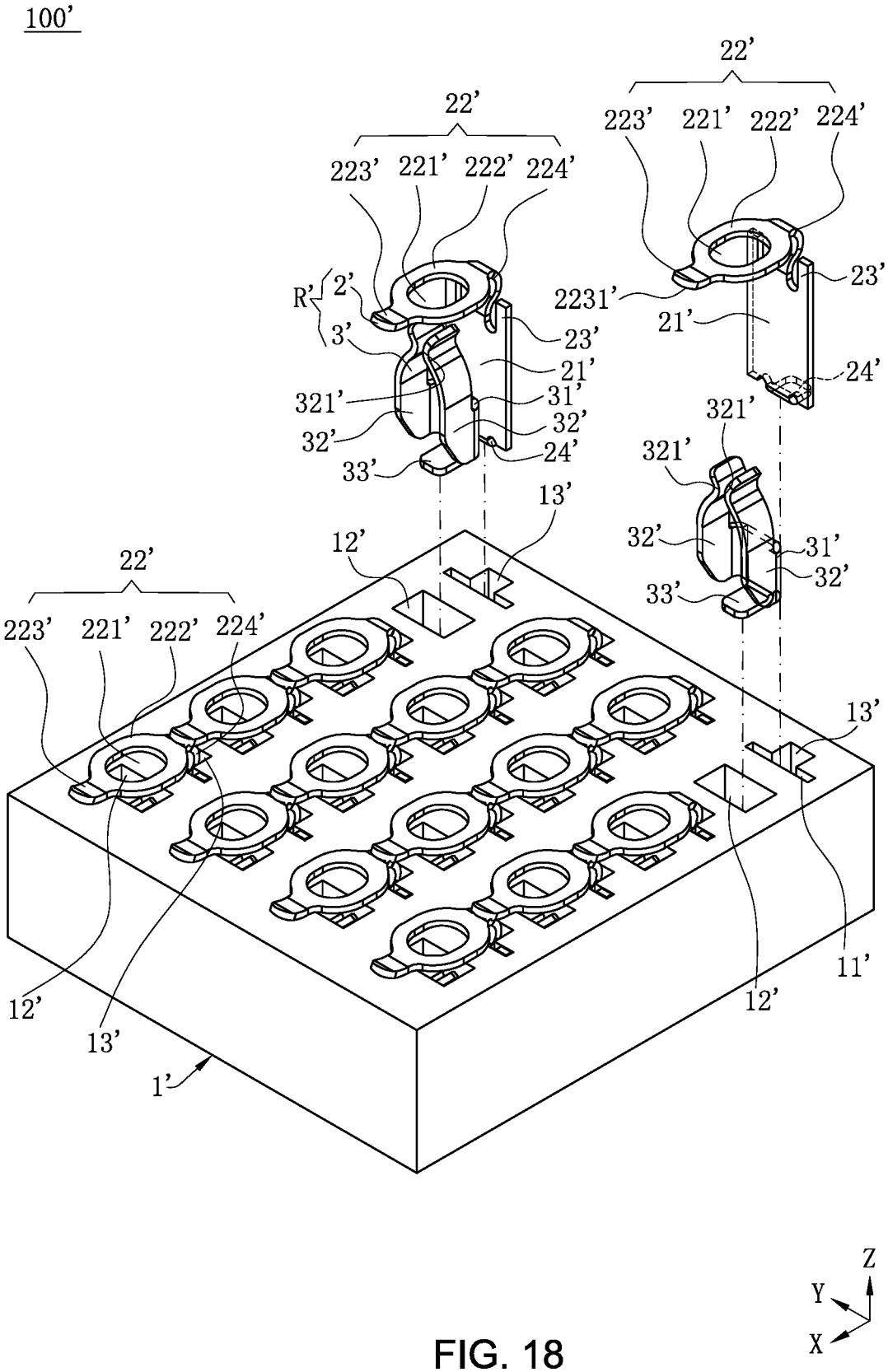
FIG. 18 is a perspective exploded view of the electrical connector in FIG. 15.

As shown in FIG. 16 and FIG. 18, the electrical connector 100' includes an insulating body 1' and a plurality of terminal groups R' mounted in the insulating body 1'. The insulating body 1' is provided with a plurality of accommodating slots 11' and a plurality of receiving slots 12' provided alternately along the front-rear direction. Each of the accommodating slots 11' and the receiving slots 12' respectively runs vertically through the insulating body 1'. The insulating body 1' is provided with a reserved slot 13' behind each accommodating slot 11', and the reserved slot 13' is in forward communication with the corresponding accommodating slot 11'. The reserved slot 13' also runs vertically through the insulating body 1'.

As shown in FIG. 16 and FIG. 18, each terminal group R' includes a ground terminal 2' and a signal terminal 3'. The ground terminal 2' is mounted in the corresponding accommodating slot 11', and the signal terminal 3' is mounted in the corresponding receiving slot 12'.

Figure 17:
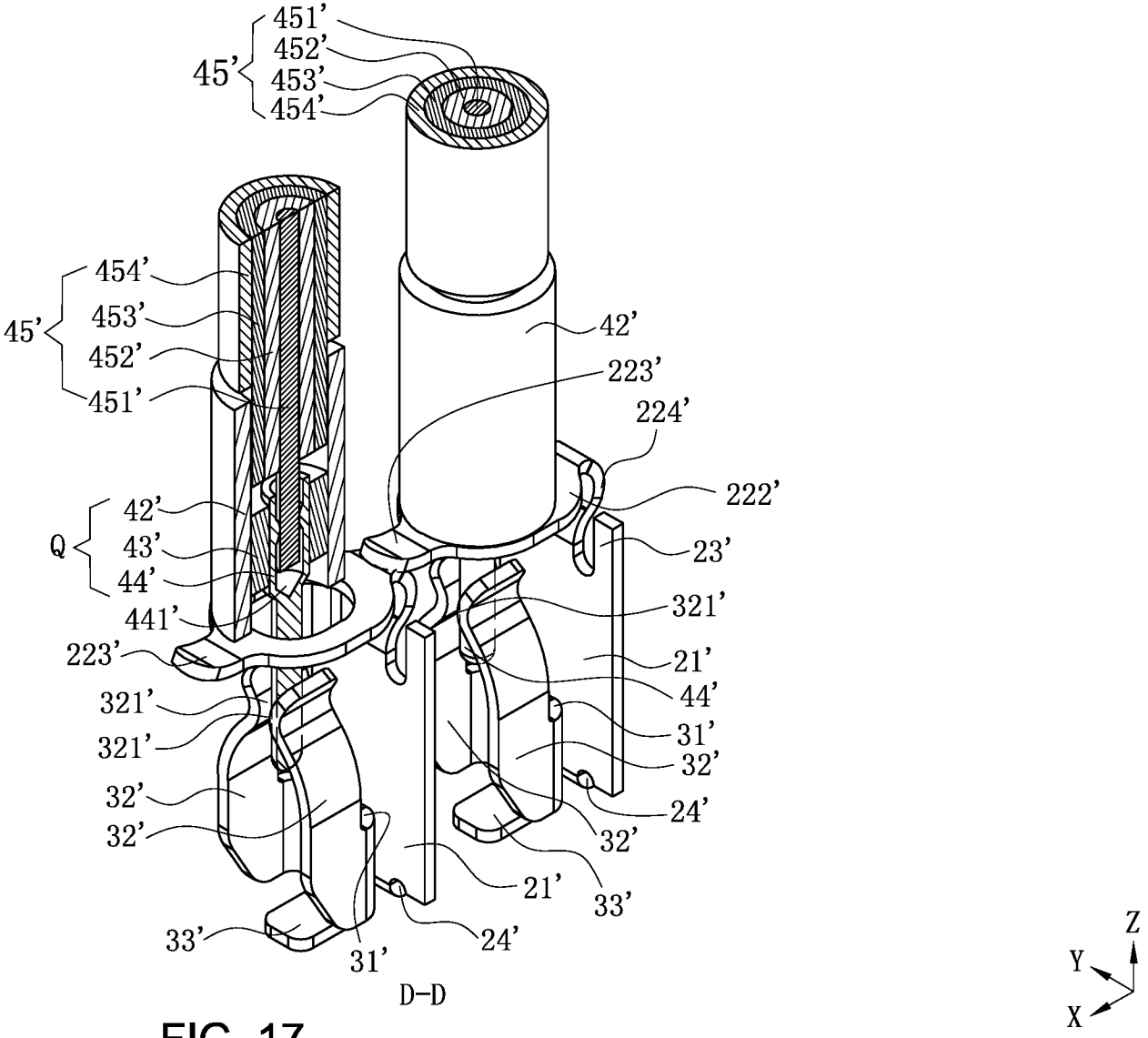
FIG. 17 is a schematic view of FIG. 15, where the terminal groups, conductor groups and coaxial cables are sectioned along a line D-D.

As shown in FIG. 17 and FIG. 18, the ground terminal 2' is assembled into the insulating body 1' downward from top thereof. The ground terminal 2' is provided with a first base portion 21', a first elastic arm 22' formed by extending from an upper end of the first base portion 21', and a soldering portion 24' formed by extending from a lower end of the first base portion 21'. The first elastic arm 22' bends forward and extends from the upper end of the first base portion 21', and the soldering portion 24' bends backward and extends from the lower end of the first base portion 21'. The first elastic arm 22' includes a through slot 221', two extending arms 222' provided at a left side and a right side of the through slot 221', a connecting arm 223 and a bending arm 224'. The bending arm 224' connects the two extending arms 222' and the first base portion 21'. The extending arms 222' are respectively formed by bending forward and extending horizontally from the bending arm 224'. The connecting arm 223' is connected to the two extending arms 222' at the ends of the two extending arms 222' away from the first base portion 21'. The connecting arm 223' includes an abutting portion 2231' bending upward and extending, and the abutting portion 2231' is used to abut the first elastic arm 22' of the ground terminal 2' located in front thereof. The soldering portion 24' is downward exposed on the lower surface of the insulating body 1'. In a process of downward mounting the ground terminal 2', the reserved slot 13' is used to be reserved for the soldering portion 24' to pass therethrough.

As shown in FIG. 18, the ground terminal 2' further includes two first strip connecting portions 23' extending upward from a left side and a right side of the upper end of the first base portion 21' to be connected to a strip. The first elastic arm 22' is located between the two first strip connecting portions 23'.

As shown in FIG. 18, the signal terminal 3' includes a second base portion 31', two second elastic arms 32' formed by extending from a left side and a right side of the second base portion 31', and a soldering leg 33' formed by extending from a lower end of the second base portion 31'. The two second elastic arms 32' extend forward and then upward from the left side and the right side of the second base portion 31'. The two second elastic arms 32' are provided opposite to each other in the left-right direction, and the two second elastic arms 32' bend toward directions facing each other. Each second elastic arm 32' is provided with a contact portion 321' on an upper end thereof, and the contact portion 321' is provided on a side surface of the corresponding second elastic arm 32' facing the other second elastic arm 32'. The soldering leg 33' bends forward and extends from the lower end of the second base portion 31'.

As shown in FIG. 17 and FIG. 18, in the same terminal group R', the signal terminal 3' is provided below the first elastic arm 22' of the ground terminal 2', and the two contact portions 321' of the two second elastic arms 32' are both located between the two extending arms 222' of the ground terminal 2'. In the two adjacent terminal groups R' along the front-rear direction, the signal terminal 3' of the terminal group R' located behind is located between the first base portion 21' of the terminal group R' located behind and the first base portion 21' of the terminal group R' located in front thereof, and the abutting portion 2231' of the ground terminal 2' of the terminal group R' located behind forward abuts the bending arm 224' of the ground terminal 2' of the terminal group R' located in front thereof, such that the ground terminals 2' arranged along the front-rear direction are altogether grounded.

Figure 15:
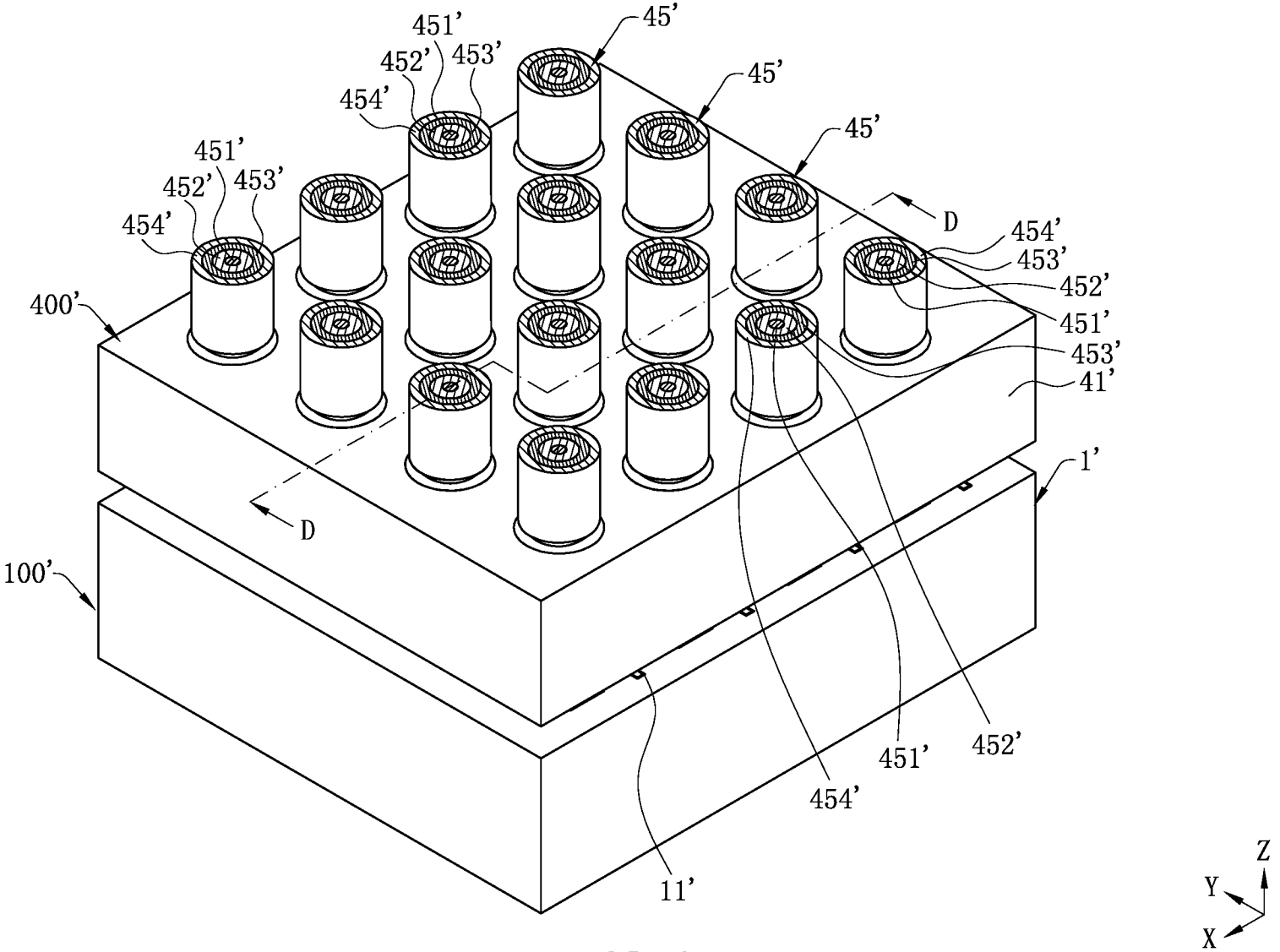
FIG. 15 is a perspective view of an electrical connector assembly according to certain embodiments of the present invention.

As shown in FIG. 15 and FIG. 16, the mating connector 400' is provided above the electrical connector 100'. The mating connector 400' includes an insulating seat 41' and a plurality of conductor groups Q' mounted in the insulating seat 41'. As shown in FIG. 16, each conductor group Q' includes a grounding conductor 42', an insulating fixing member 43' provided in the grounding conductor 42', a signal conductor 44' provided in the insulating fixing member 43', and a coaxial cable 45'. The grounding conductor 42' and the insulating fixing member 43' are both provided in tubular shapes, and the signal conductor 44' is provided in a needle shape. The signal conductor 44' and the grounding conductor 42' are provided to be separated by the insulating fixing member 43'. The signal conductor 44' is fixed by interference to the insulating fixing member 43', and the insulating fixing member 43' is fixed by interference to the grounding conductor 42'.

As shown in FIG. 16, each of an upper end surface and a lower end surface of the grounding conductor 42' is provided as a horizontal ring surface. The upper end surface of the grounding conductor 42' and an upper surface of the insulating seat 41' are flush, and the lower end surface of the grounding conductor 42' protrudes out of a lower surface of the insulating seat 41' to abut the first elastic arm 22' of one of the ground terminals 2'. An upper end surface of the insulating fixing member 43' is provided to be lower than the upper surface of the insulating seat 41', and a lower surface of the insulating fixing member 43' is provided to be higher than the lower surface of the insulating seat 41'. An upper end of the signal conductor 44' is fixed in the insulating fixing member 43', and an insertion slot 441' is concavely provided on the upper end of the signal conductor 44'. A lower end of the signal conductor 44' protrudes out of the lower end surface of the grounding conductor 42' to be electrically connected to one of the signal terminals 3'.

As shown in FIG. 16 and FIG. 17, the coaxial cable 45' includes a wire 451', and an insulating layer 452', a shielding layer 453' and an insulating skin 454' sequentially covering outside the wire 451' outward from inside thereof. A lower end surface of the shielding layer 453' is provided to be lower than a lower end surface of the insulating skin 454' in the vertical direction. The shielding layer 453' is provided as a weaving web, and is used to be electrically connected to the grounding conductor 42'. Specifically, in this embodiment, an upper end of the grounding conductor 42' is sleeved outside the shielding layer 453', and the two components are fixed to each other. A lower end surface of the insulating layer 452' and the lower end surface of the shielding layer 453' are flush. The insulating layer 452' is used to separate the shielding layer 453' and the wire 451'. The wire 451' protrudes downward out of the lower end surface of the insulating layer 452', and a lower end of the wire 451' is inserted into the insertion slot 441' of the corresponding signal conductor 44' to be electrically connected to the corresponding signal conductor 44'. A hardness of the wire 451' is less than a hardness of the signal conductor 44'. A lower end of the insulating skin 454' is fixed above the insulating seat 41'.

As shown in FIG. 16 and FIG. 17, the mating connector 400' is inserted downward into the electrical connector 100'. Specifically, each conductor group Q' is downward inserted into a corresponding terminal group R', and each grounding conductor 42' downward abuts the two extending arms 222' of the corresponding ground terminal 2', such that the grounding conductor 42' and the corresponding ground terminal 2' are electrically connected. The signal conductor 44' is inserted downward between the two second elastic arms 32' of the corresponding signal terminal 3', and respectively abuts the contact portions 321' of the two second elastic arms 32' of the corresponding signal terminal 3'. The contact portions 321' of the two second elastic arms 32' of the signal terminal 3' are located below the first elastic arm 22' of the corresponding ground terminal 2' in each terminal group R', such that the abutting and contact location of the signal conductor 44' and the corresponding signal terminal 3' is also located below the two extending arms 222' of the corresponding ground terminal 2'. In other embodiments, it is possible for a coaxial cable 45' to be directly inserted downward into a corresponding terminal group R', and the shielding layer 453' downward abuts the two extending arms 222' of the corresponding ground terminal 2', such that the shielding layer 453' and the corresponding ground terminal 2' are electrically connected. The wire 451' is inserted downward between the two second elastic arms 32' of the corresponding signal terminal 3', and respectively abuts the contact portions 321' of the two second elastic arms 32' of the corresponding signal terminal 3'.

In sum, the electrical connector and the electrical connector assembly according to certain embodiments of the present invention have the following beneficial effects:

1) Compared with the related art, in the electrical connector 100 according to certain embodiments of the present invention, each terminal group R includes a ground terminal 2 and a signal terminal 4, and in the same terminal group R, the signal terminal 4 is provided between the two extending arms 222 of the corresponding ground terminal 2, such that the signal terminal 4 is shielded by the two extending arms 222 in the left-right direction, which is equivalent to the signal terminal 4 in each terminal group R being correspondingly provided with a shielding member, increasing the shielding effect between the adjacent signal terminals 4. Further, the signal terminal 4 of the terminal group R located behind is located between the two first base portions 21 of the two adjacent terminal groups R in the front-rear direction, such that the signal terminal 4 of the terminal group R located behind is shielded by the two first base portions 21 of the two adjacent ground terminals 2 in the front-rear direction, further increasing the shielding effect between the adjacent signal terminals 4. The mating member 500 presses on the first elastic arm 22, and the first elastic arm 22 of the ground terminal 2 in the terminal group R located behind abuts the ground terminal 2 of the terminal group R located in front thereof, such that the ground terminals 2 of the two adjacent terminal groups R in the front-rear direction are connected to each other and altogether grounded, thus reducing a potential difference between the ground terminals 2 in the two adjacent terminal groups R in the front-rear direction, achieving zero potential, and further increasing the shielding effect between the adjacent signal terminals 4.

2) In the same terminal group R, the signal terminal 4 as a whole is provided in front of the first base portion 21 of the ground terminal 2, the first contact portion 2234 of the ground terminal 2 is located in front of the second contact portion 421 of the signal terminal 4, and the signal terminal 4 is provided between the two extending arms 222 of the ground terminal 2 provided in the left-right direction. Thus, the ground terminals 2 shield the signal terminal 4 in the same terminal group R from four directions, including the front, back, left and right direction. Compared to the related art where two ground terminals 2 are respectively provided at two sides of the signal terminal 4, the ground terminal 2 in the same terminal group R may shield the corresponding signal terminal 4, thus saving the space.

3) Compared with the related art where the first contact portions 2234 of the ground terminals 2 and the second contact portions 421 of the signal terminals 4 are provided on two individual straight lines, in the same space, the technology where the first contact portions 2234 of the ground terminals 2 and the second contact portions 421 of the signal terminals 4 are provided in a same straight line allows more first contact portions 2234 and more second contact portions 421 to be arranged, thus increasing the transmission amount between the electrical connector 100 and the mating member 500.

4) The first elastic arm 22 of the terminal group R located behind forward abuts the first elastic arm 22 of the terminal group R located in front thereof. The first elastic arm 22 has elasticity, such that when the mating member 500 or the circuit board 600 presses on the first contact portion 2234 of the first elastic arm 22 and the first elastic arm 22 is electrically connected to the mating member 500 or the circuit board 600, the first elastic arm 22 elastically deforms, and the ground terminals 2 of the adjacent terminal groups R in the front-rear direction switch from the status of being individually grounded to the status of being altogether grounded, thus fully utilizing the elastic deformation characteristics of the first elastic arm 22.

5) The first elastic arm 22 includes two extending arms 222 and a connecting arm 223. The connecting arm 223 is connected to the ends of the two extending arms 222 away from the first base portion 21, and abuts the ground terminal 2 in front thereof by the abutting portion 2233 of the connecting arm 223. Thus, the connecting arm 223 accumulates the stress applied to the two extending arms 222, allowing better control to the first elastic arm 22 to forward abut the ground terminal 2 of the terminal group R located in front thereof.

6) The first elastic arm 22' includes two extending arms 222' and a connecting arm 223'. The connecting arm 223' is connected to the ends of the two extending arms 222' away from the first base portion 21', and abuts the ground terminal 2' in front thereof by the abutting portion 2231' of the connecting arm 223'. Thus, the connecting arm 223' accumulates the stress applied to the two extending arms 222', allowing better control to the first elastic arm 22' to forward abut the ground terminal 2' of the terminal group R' located in front thereof.

7) In the two adjacent terminal groups R in the front-rear direction, in a top view, the projection of at least a portion of the connecting arm 223 of the terminal group R located behind on a horizontal plane is located between the projections of the two extending arms 222 of the terminal group R located in front thereof. Thus, an overlapping area exists between the two adjacent terminal groups R in the front-rear direction, further saving the space, reducing an interval between the terminal groups R, and increasing the density of the electrical connector 100.

8) The opening slot 211 of the first base portion 21 provides a deformation space for the two retaining plates 212 to move toward directions facing each other.

9) The side plates 23 are provided at the left side and the right side of the first base portion 21, and the side plates 23 respectively abut the two first elastic arms 22 on the upper end and the lower end of the first base portion 21, thus shortening the backflow path between the two first elastic arms 22 in the vertical direction.

10) In the same terminal group R, the two insulating blocks 3 are injection molded on the two corresponding side plates 23, and the signal terminal 4 is fixed between the two corresponding insulating blocks 3, such that the signal terminal 4 is stably fixed to the corresponding ground terminal 2, and the signal terminal 4 and the ground terminal 2 are separated by the insulating blocks 3, preventing the two from short-circuiting.

11) Compared with the related art, in the electrical connector assembly according to certain embodiments of the present invention, the signal terminal 3' is located between the two first base portions 21' of the two ground terminals 2', and the two first base portions 21' shield the signal terminal 3', reducing the signal interference between the signal terminal 3' and other adjacent signal terminals 3'. The grounding conductor 42' presses on the first elastic arm 22' of the ground terminal 2' located behind, and the first elastic arm 22' of the ground terminal 2' located behind abuts the ground terminal 2' located in front thereof, such that the two ground terminals 2' arranged in the front-rear direction are altogether grounded, thus reducing a potential difference between the two adjacent ground terminals 2' arranged in the front-rear direction, achieving zero potential, and further reducing the signal interference between the signal terminal 3' and other adjacent signal terminals 3'. Further, the signal conductor 44' of the mating connector 400' is located between the two extending arms 222' of the corresponding ground 2' terminal of the electrical connector 100', such that the two extending arms 222' of the ground terminal 2' located behind of the electrical connector 100' further shield the signal conductor 44' of the mating connector 400'. Thus, the ground terminal 2' located behind of the electrical connector 100' shields not only the signal terminal 3' of the electrical connector 100' but also the signal conductor 44' of the mating connector 400', enhancing the utilization rate of the ground terminal 2' located behind.

12) The connecting arm 223' bends upward to form an abutting portion 2231', and the abutting portion 2231' bending upward is convenient to downward abut the bending arm 224' of the first elastic arm 22' of the ground terminal 2' located in front thereof, thus ensuring the stable abutting between the abutting portion 2231' and the bending arm 224'.

13) The grounding conductor 42' is provided in a tubular shape, and presses downward on the two corresponding extending arms 222', thus providing a space reserved for the signal conductor 44' located in the grounding conductor 42' and protruding out of the grounding conductor 42' to be inserted downward into the corresponding signal terminal 3', ensuring the signal conductor 44' to be located between the two extending arms 222' of the ground terminal 2', and facilitating shielding to the signal conductor 44' by the ground terminal 2'.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a mating member, the electrical connector comprising:

two terminal groups, provided to be adjacent in a front-rear direction, wherein one of the two terminal groups located in front thereof is defined as a front terminal group, the other of the two terminal groups located behind is defined as a rear terminal group, each of the two terminal groups comprises a ground terminal and a signal terminal, the ground terminal is provided with a first base portion and a first elastic arm formed by extending from the first base portion, the first elastic arm comprises two extending arms and a through slot formed between the two extending arms, the signal terminal is provided with a second base portion and a second elastic arm formed by extending from the second base portion, and the first elastic arm and the second elastic arm are configured to be electrically connected to the mating member;

wherein in a same terminal group of the two terminal groups, the signal terminal is located in front of the first base portion, and the second elastic arm runs through the through slot;

wherein the mating member presses on the first elastic arm, and the first elastic arm of the ground terminal of the rear terminal group abuts the ground terminal of the front terminal group to form an electrical connection therebetween.

2. The electrical connector according to claim 1, wherein the first elastic arm is provided with a first contact portion, the second elastic arm is provided with a second contact portion, and in the same terminal group, the first contact portion is located in front of the second contact portion.

3. The electrical connector according to claim 2, wherein the first contact portions and the second contact portions in the two terminal groups are located on a same straight line extending along the front-rear direction.

4. The electrical connector according to claim 1, wherein the first elastic arm has a connecting arm, an end of each of the two extending arms located away from the first base portion is connected to the connecting arm, and the connecting arm of the first elastic arm is configured to be electrically connected to the mating member.

5. The electrical connector according to claim 4, wherein a projection of at least a portion of the connecting arm of the rear terminal group on a horizontal plane is located between projections of the two extending arms of the front terminal group on the horizontal plane.

6. The electrical connector according to claim 1, wherein the mating member presses downward on the first elastic arm, and the first elastic arm of the ground terminal of the rear terminal group abuts the first elastic arm of the ground terminal of the front terminal group.

7. The electrical connector according to claim 1, wherein at least one side of the first elastic arm of the rear terminal group is provided with an abutting portion to abut the ground terminal of the front terminal group to form an electrical connection therebetween.

8. The electrical connector according to claim 7, wherein two sides of the first elastic arm of the rear terminal group are respectively provided with two abutting portions to one-to-one correspondingly abut the two extending arms of the front terminal group.

9. The electrical connector according to claim 1, wherein the first base portion is provided with an opening slot, and the opening slot is in communication with the through slot.

10. The electrical connector according to claim 1, wherein two side plates are formed by respectively bending forward and extending from a left side and a right side of the first base portion, each of the two side plates is fixed with an insulating block, and in the same terminal group, the insulating blocks of the two side plates position the corresponding signal terminal.

11. The electrical connector according to claim 10, wherein each of the side plates is provided with at least one forming hole, and the insulating block is injection molded on a corresponding one of the two side plates and filled in the forming hole.

12. The electrical connector according to claim 10, wherein the two side plates of the ground terminal one-to-one correspondingly upward abut the two extending arms of the ground terminal.

13. The electrical connector according to claim 10, further comprising an insulating body, wherein the left side and the right side of the first base portion are fixed to the insulating body.

14. The electrical connector according to claim 1, wherein the ground terminal is provided with two first elastic arms, one of the two first elastic arms is formed by extending upward from an upper end of the first base portion to be electrically connected to the mating member, the other of the two first elastic arms is formed by extending downward from a lower end of the first base portion to be electrically connected to a circuit board, the signal terminal is provided with two second elastic arms, one of the two second elastic arms is formed by extending upward from an upper end of the second base portion to be electrically connected to the mating member, the other of the two second elastic arms is formed by extending downward from a lower end of the second base portion to be electrically connected to the circuit board, and in the same terminal group, the second elastic arm provided on the upper end of the second base portion passes upward through the through slot of the first elastic arm provided on the upper end of the first base portion, and the second elastic arm provided on the lower end of the second base portion passes downward through the through slot of the first elastic arm provided on the lower end of the first base portion.

15. The electrical connector according to claim 14, wherein the circuit board presses upward on the first elastic arm provided on the lower end of the first base portion, and the first elastic arm provided on the lower end of the first base portion of the rear terminal group abuts the ground terminal of the front terminal group to form an electrical connection therebetween.

16. An electrical connector, configured to be electrically connected to a mating member, the electrical connector comprising:

two ground terminals provided to be adjacent in a front-rear direction, wherein each of the two ground terminals is provided with a first base portion and a first elastic arm formed by extending from the first base portion to be electrically connected to the mating member, the two first base portions of the two ground terminals are arranged in the front-rear direction, and the first elastic arm of the ground terminal located behind comprises two extending arms; and a signal terminal, configured to be electrically connected to the mating member, wherein the signal terminal is located between the two first base portions of the two ground terminals, and the signal terminal is located between the two extending arms;

wherein the mating member presses on the first elastic arm, and the first elastic arm of the ground terminal located behind abuts the ground terminal located in front thereof to form an electrical connection therebetween.

17. The electrical connector according to claim 16, wherein the first elastic arm is provided with a first contact portion, the signal terminal is provided with a second contact portion, and the two first contact portions of the two ground terminals are both located in front of the second contact portion.

18. The electrical connector according to claim 17, wherein the first elastic arm of the ground terminal located behind is provided with at least one abutting portion to abut the ground terminal located in front thereof at an abutting location, and the abutting location is located behind the first contact portion of the ground terminal located behind and is located in front of the second contact portion.

19. The electrical connector according to claim 16, wherein the ground terminal located behind is provided with two first elastic arms, one of the two first elastic arms is formed by extending upward from an upper end of the first base portion of the ground terminal located behind to be electrically connected to the mating member, the other of the two first elastic arms is formed by extending downward from a lower end of the first base portion of the ground terminal located behind to be electrically connected to a circuit board, each of the two first elastic arms of the ground terminal located behind is provided with a through slot, and the through slot is located between the two extending arms of each of the two first elastic arms.

20. The electrical connector according to claim 19, wherein the first base portion of the ground terminal located behind is provided with an opening slot, and the opening slot is in communication with the two through slots of the two elastic arms of the ground terminal located behind.

21. The electrical connector according to claim 19, wherein the signal terminal comprises a second base portion and two second elastic arms formed by respectively extending from an upper end and a lower end of the second base portion, the second elastic arm provided on the upper end of the second base portion passes upward through the through slot of the first elastic arm provided on the upper end of the first base portion, and the second elastic arm provided on the lower end of the second base portion passes downward through the through slot of the first elastic arm provided on the lower end of the first base portion.

22. The electrical connector according to claim 19, wherein two side plates are formed by respectively bending forward and extending from a left side and a right side of the first base portion of the ground terminal located behind, and each of the side plates is provided between and abuts the two first elastic arms of the ground terminal located behind.

23. The electrical connector according to claim 22, wherein each of the two side plates is fixed with an insulating block, and the insulating blocks of the two side plates position the signal terminal.

24. The electrical connector according to claim 16, wherein the first elastic arm of each of the ground terminals comprises the two extending arms, the mating member presses on the first elastic arm, and the two extending arms of the ground terminal located behind one-to-one correspondingly abut the two extending arms of the ground terminal located in front thereof to form an electrical connection therebetween.

25. The electrical connector according to claim 16, wherein the two ground terminals adjacent in the front-rear direction are arranged to be staggered in a left-right direction, the mating member presses on the first elastic arm, and one of the two extending arms of the ground terminal located behind forward abuts the ground terminal located in front thereof to form an electrical connection therebetween.

26. An electrical connector assembly, comprising:

an electrical connector, comprising two ground terminals and a signal terminal, the two ground terminals are arranged in a front-rear direction, each of the ground terminals is provided with a first base portion and a first elastic arm formed by extending from the first base portion, the first elastic arm of the ground terminal located behind comprises two extending arms, and the signal terminal is located between the two first base portions of the two ground terminals; and a mating connector mated with the electrical connector, the mating connector comprising a grounding conductor and a signal conductor, wherein the grounding conductor presses on the first elastic arm of the ground terminal located behind, the first elastic arm of the ground terminal located behind abuts the ground terminal located in front thereof to form an electrical connection therebetween, the signal conductor is located between the two extending arm and is in contact with the signal terminal to form an electrical connection therebetween.

27. The electrical connector assembly according to claim 26, wherein the first elastic arm of the ground terminal located behind has a connecting arm, an end of each of the two extending arms located away from the first base portion is connected to the connecting arm, and the connecting arm of the ground terminal located behind abuts the ground terminal located in front thereof.

28. The electrical connector assembly according to claim 27, wherein the connecting arm has an abutting portion formed by bending upward from an end of the connecting arm located away from the two extending arms, and the abutting portion abuts the first elastic arm of the ground terminal located in front thereof to form an electrical connection therebetween.

29. The electrical connector assembly according to claim 26, wherein the grounding conductor presses the two extending arms downward to form an electrical connection therebetween.

30. The electrical connector assembly according to claim 26, wherein a contact location of the signal conductor and the signal terminal is located below the extending arms.

31. The electrical connector assembly according to claim 26, wherein the grounding conductor is in a tubular shape and is surroundingly provided outside the signal conductor, and the signal conductor protrudes downward out of the grounding conductor.

32. The electrical connector assembly according to claim 26, wherein the mating connector further comprises an coaxial cable, the coaxial cable comprises a wire, a shielding layer, an insulating layer provided between the wire and the shielding layer, and an insulating skin covering outside the shielding layer, the wire is connected to the signal conductor, and the shielding layer is connected to the grounding conductor.

33. The electrical connector assembly according to claim 32, wherein a hardness of the signal conductor is greater than a hardness of the wire, the mating connector comprises an insulating fixing member fixing the signal conductor and the wire, and the insulating fixing member is located between the grounding conductor and the signal conductor.

34. The electrical connector assembly according to claim 26, wherein the signal terminal comprises a second base portion and two second elastic arms formed by extending upward from the second base portion, and the signal conductor is provided to be clamped between the two second elastic arms to be electrically connected to the signal terminal.

35. The electrical connector assembly according to claim 26, wherein the two extending arms are located on a same horizontal plane.

* * * * *